US006427599B1

(12) United States Patent
Posson et al.

(10) Patent No.: US 6,427,599 B1
(45) Date of Patent: Aug. 6, 2002

(54) PYROTECHNIC COMPOSITIONS AND USES THEREFORE

(75) Inventors: Philip L. Posson, Walnut Creek; Albert J. Baggett, Jr., San Carlos, both of CA (US)

(73) Assignee: BAE Systems Integrated Defense Solutions Inc., Austin, TX (US)

( * ) Notice: Subject to any disclaimer, the term of this patent is extended or adjusted under 35 U.S.C. 154(b) by 0 days.

(21) Appl. No.: 08/924,039

(22) Filed: Aug. 29, 1997

(51) Int. Cl.[7] ..... F42B 4/26
(52) U.S. Cl. ..... 102/336
(58) Field of Search ..... 102/336

(56) References Cited

U.S. PATENT DOCUMENTS

| | | | | |
|---|---|---|---|---|
| 3,605,624 A | | 9/1971 | Dinsdale et al. | 102/37.8 |
| 3,609,115 A | | 9/1971 | Sammons et al. | 260/32.4 |
| 3,662,802 A | | 5/1972 | Bedell | 149/36 |
| 3,680,483 A | | 8/1972 | Staudacher et al. | 102/37.8 |
| 3,745,927 A | | 7/1973 | Tanner et al. | 102/103 |
| 3,853,645 A | | 12/1974 | Kaufman et al. | 149/19.3 |
| 3,878,396 A | | 4/1975 | Vallet | 250/493 |
| 3,895,578 A | | 7/1975 | Shaw et al. | 102/37.8 |
| 4,069,762 A | | 1/1978 | Maury | 102/90 |
| 4,098,625 A | | 7/1978 | French et al. | 149/19.3 |
| 4,196,129 A | | 4/1980 | Rhein et al. | 260/346.3 |
| 4,276,100 A | | 6/1981 | Colvin et al. | 149/109.6 |
| 4,739,708 A | * | 4/1988 | Halpin et al. | 102/336 |
| 4,768,439 A | * | 9/1988 | Singer et al. | 102/336 |
| 4,863,534 A | | 9/1989 | Forsberg | 149/2 |
| 4,881,464 A | * | 11/1989 | Sayles | 102/336 |
| 5,136,950 A | | 8/1992 | Halpin et al. | 102/336 |
| 5,317,163 A | | 5/1994 | Obkircher | 250/495.1 |
| 5,343,794 A | | 9/1994 | Andreotti et al. | 89/1.11 |
| 5,456,455 A | | 10/1995 | Dillehay et al. | 264/3.1 |
| 5,531,163 A | | 7/1996 | Dillehay et al. | 102/288 |
| 5,561,260 A | | 10/1996 | Towning et al. | 102/336 |
| 5,639,984 A | * | 6/1997 | Nielson | 102/336 |
| 5,661,257 A | * | 8/1997 | Nielson et al. | 102/336 |
| 5,679,921 A | * | 10/1997 | Hahn et al. | 102/336 |
| 5,912,430 A | * | 6/1999 | Nielson | 102/336 |
| 6,013,144 A | * | 1/2000 | Callaway | 102/336 |

FOREIGN PATENT DOCUMENTS

| | | | | |
|---|---|---|---|---|
| GB | 2266944 A | * | 11/1993 | 102/336 |

* cited by examiner

*Primary Examiner*—Peter A. Nelson
(74) *Attorney, Agent, or Firm*—Fulbright & Jaworski, LLP

(57) ABSTRACT

Pyrotechnic compositions having combustion reaction products that include a high percentage of carbon dioxide at high temperatures. These pyrotechnic compositions include a fuel component having combustion product with a relatively high percentage of carbon to hydrogen content, such as an aromatic polycarboxylic anhydride fuel component. These pyrotechnic compositions may be employed to emit infrared radiation from a decoy flare or other device. The compositions may also be employed as a gas generating propellant for a projectile, such as a flare or rocket, or for other applications such as an automobile airbag. These pyrotechnic compositions emit infrared emissions with minimized short wavelength components, and produce substantially non-toxic combustion gases having relatively small amounts of water vapor.

18 Claims, 8 Drawing Sheets

INTEGRATED VALUES FOR 1.98 SEC.
(X VALUE = 5.00000 SECONDS FS @ 1.00000 SEC/DIV)

PYROTECHNIC COMPOSITIONS AND USES THEREFORE

BACKGROUND OF THE INVENTION

1. Field of the Invention

This invention relates generally to pyrotechnic compositions and, more specifically, to pyrotechnic compositions having combustion reaction products that include a high percentage of carbon dioxide at high temperatures. In particular, this invention relates to pyrotechnic compositions which include a fuel-component that is a compound having a relatively high carbon content and a relatively low hydrogen content. Examples of such compounds include, but are not limited to, aromatic polycarboxylic anhydrides, aliphatic polycarboxylic acid anhydrides, quinones, acetylenics, acid salts, polycyano compounds, substituted polynuclear compounds, polyanhydrides, polymeric anhydrides or polylactone compounds having combustion products having a relatively high long to short wavelength infrared output color ratio and/or a relatively high percentage of $CO_2$ and a relatively low percentage of $H_2O$.

2. Description of the Related Art

Infrared decoy flares are used by aircraft as protection against attack by heat seeking missiles. These flares are typically ejected from an aircraft and ignited to produce infrared ("IR") radiation that simulates the infrared emissions of aircraft engines of the targeted aircraft. The IR emissions of the decoy flare are intended to confuse a heat seeking anti-aircraft missile, thereby causing the missile to turn away from the target aircraft toward the decoy flare.

Modern heat seeking anti-aircraft missiles typically employ seeker heads capable of distinguishing between short and long wavelength IR emissions. Long wavelength IR emissions are typically produced by aircraft components, such as hot jet engines. Short wavelength IR emissions are characteristic of gray-body materials having higher temperatures and/or heated water vapor. In this respect, missile seeker heads may be configured to compare particular IR output color ratios. As used herein, "color ratio" is defined as the ratio of long wavelength IR output ("LW") to short wavelength IR output ("SW").

Because seeker heads of anti-aircraft missiles are designed to identify IR characteristics of aircraft engine emissions, flare decoy burn requirements are dictated by the characteristics of aircraft engine IR emissions. Aircraft engines typically produce a spectrum of IR radiation characteristic of a gray-body radiator in the 600–900 degree Centigrade range. In this regard, a flare decoy should burn to produce IR emissions having a large percentage of long IR wavelengths, similar to aircraft engine emissions.

In the past, flares have been configured to include combustible flare pellets, which are ignited when a decoy flare is deployed. Flare pellets have typically included a shaped quantity of flare material coated with an ignition composition. For example, a typical flare pellet is made of a solid pyrotechnic composition that includes magnesium, "TEFLON", and "VITON" (this composition is commonly known as "MTV"), the latter two components being commercially available from DuPont. Such conventional flare compositions suffer from several disadvantages. For example, they may emit IR radiation which does not correspond with IR emissions of the missile target, especially when used against missiles which measure or detect the IR color ratio of targets.

In order to address these and other problems, certain "two color" decoy flare compositions have been developed which will generate IR color ratios more similar to that of targeted aircraft. For example, "two color" boron-based and red phosphorous-based compositions that produce flare emissions with higher LW/SW color ratios than MTV have been developed. However, the IR output of such two color compositions typically degrades in a windstream, exhibiting increased short wavelength IR energy when a decoy flare is ejected from an aircraft. Generally, the output color ratio of such a flare changes with increases in wind speed until it no longer matches the signature of a jet engine exhaust at operating temperatures, thus allowing a heat seeking anti-aircraft missile to distinguish the decoy flare from the aircraft.

In order to address windstream IR emission degradation, several measures have been taken. For example, protective shields have been added to keep the wind stream from directly impinging on the flare plume. These devices tend to be cumbersome and relatively inefficient. In other cases, decoy flare devices which control mixing of air with the output of flare compositions have also been developed. These devices tend to be costly and/or mechanically complex.

SUMMARY OF THE INVENTION

In one respect this invention is a pyrotechnic composition having the property that combustion of the pyrotechnic composition produces a combustion product with a molecular ratio of $CO_2$ to $H_2O$ of greater than about 1.0. In other embodiments this molecular ration may be greater than about 2.0 or 4.0, respectively. This composition may also have the property that combustion of the pyrotechnic composition produces infrared emissions having an output infrared color ratio of greater than about 1.0 or, in another embodiment, greater than about 3.0. In one typical embodiment, the pyrotechnic composition includes a fuel component including at least one aromatic polycarboxylic acid anhydride. In this embodiment, the aromatic polycarboxylic acid anhydride may be, among other things, any one of benzene tetracarboxylic acid dianhydride, benzophenone tetracarboxylic dianhydride, benzene hexacarboxylic acid trianhydride, or a mixture thereof. In another embodiment, the pyrotechnic composition may include a fuel component including anthraquinone. In another embodiment, the pyrotechnic composition may have an oxidizing agent and an afterburning stoichiometry, in which the pyrotechnic composition includes an amount of oxidizing agent sufficient to supply between about 40% and about 95% of the stoichiometric amount of oxidizing agent required for complete combustion of the fuel component. In another embodiment, the pyrotechnic composition may have a fuel component, further include an oxidizing agent, and have an afterburning stoichiometry, in which the pyrotechnic composition includes between about 28% and about 40% by weight of the fuel component, and between about 45% and about 69% by weight of the oxidizing agent.

In another respect, this invention is a pyrotechnic composition having the property that combustion of the pyrotechnic composition produces infrared emissions having an output infrared color ratio of greater than about 3:1. In one embodiment of this composition, the pyrotechnic composition may have the property that combustion of the pyrotechnic composition produces infrared emissions having an output infrared color ratio of greater than about 3:1 under windstream conditions of about Mach 0.2. In another embodiment of this composition, the pyrotechnic composition may have the property that combustion of the pyrotechnic composition produces a combustion product having a molecular ratio of $CO_2$ to $H_2O$ of greater than about 1.0. In still another embodiment of this composition, the pyrotechnic composition may have the property that combustion of the pyrotechnic composition produces infrared emissions having an output infrared color ratio of greater than about 1:1 under windstream conditions of about Mach 0.2. In yet still another embodiment of this composition, the pyrotechnic composition may have the property that combustion of the pyrotechnic composition produces infrared emissions having an output infrared color ratio of greater than about 1:1 under windstream conditions of up to at least about Mach 0.75. In still yet another embodiment of this composition, the pyrotechnic composition may have the property that combustion of the pyrotechnic composition produces infrared emissions having an output infrared color ratio of greater than or equal to about 1.5:1 under windstream conditions of up to at least about Mach 0.7. In yet still another embodiment of this composition, the pyrotechnic composition may have the property that combustion of the pyrotechnic composition produces infrared emissions having an output infrared color ratio of greater than or equal to about 2:1 under windstream conditions of about Mach 0.2. In a further embodiment of this composition, the pyrotechnic composition may include a fuel component comprising at least one of an anhydride, polyactone, quinone, acetylenic compound, acid salt compound, polycyano compound, polynuclear compound, or a mixture thereof. In this regard, the fuel component may include at least one of an aromatic mono-anhydride, aromatic poly-anhydride, aliphatic mono-anhydride, aliphatic poly-anhydride, or a mixture thereof. The fuel component may include at least one of an aromatic polycarboxylic acid anhydride, an aliphatic polycarboxylic acid anhydride, or a mixture thereof. The fuel component may include at least one aromatic polycarboxylic acid anhydride. In another embodiment of this composition, the fuel component may include an aromatic polycarboxylic acid anhydride present in an amount of between about 12% and about 40% by weight. In still another embodiment, the fuel component may include an aromatic polycarboxylic anhydride having one or more nitro functionalities. In another embodiment of this compostion, the fuel component may include at least one of benzene tetracarboxylic dianhydride, benzophenone tetracarboxylic dianhydride, benzene hexacarboxylic acid trianhydride, mellitic anhydride, or a mixture thereof. The fuel component may include at least one of benzene tetracarboxylic dianhydride, benzophenone tetracarboxylic dianhydride, mellitic anhydride, or a mixture thereof. The fuel component may include benzene tetracarboxylic dianhydride. The fuel component may include benzophenone tetracarboxylic dianhydride. The fuel component may include benzene hexacarboxylic acid trianhydride. The fuel component may include an aliphatic polycarboxylic acid anhydride, the polycarboxylic acid anhydride being at least one of maleic anhydride, maleic anhydride derivative, succinic anhydride, or a mixture thereof. The fuel component may include a polycyano compound, the polycyano compound being at least one of an aromatic cyano compound, an aliphatic cyano compound, or a mixture thereof. The fuel component may include at least one quinone, the quinone being at least one of a p-quinone derivative, an aromatic polynuclear quinone derivative, or a mixture thereof. The fuel component may include at least one of a quinone bearing two or less nitro groups per molecule, a quinone bearing two or less oxime groups per molecule, an anthraquinone, or a mixture thereof. The fuel component may include anthraquinone. The fuel component may include at least one of a mono-nitroanthraquinone, a di-nitroanthraquinone, a p-quinone dioxime, or a mixture thereof. The fuel component may include at least one acid salt compound or a mixture of acid salt compounds. The fuel component may include at least one acetyleneic compound or a mixture of acetyleneic compounds. The fuel component may include at least one polynuclear compound or a mixture of polynuclear compounds. This pyrotechnic composition may further include a binding agent that includes at least one of an elastomeric polymer, an epoxy resin, or a mixture thereof. This pyrotechnic composition may further include an oxidizing agent, the oxidizing agent comprising at least one of an alkali metal nitrate, perchlorate, or a mixture thereof. Another embodiment of this composition may include a fuel component that may include at least one of a nitrilotriacetonitrile, a dicyanobenzene, a malononitrile dimer, a malononitrile derivative, cyanoguanidine, or a mixture thereof.

In another respect, this invention is a pyrotechnic composition including at least one of an aromatic mono-anhydride, aromatic poly-anhydride, aliphatic mono-anhydride, aliphatic poly-anhydride, or a mixture thereof.

In another respect, this invention is a pyrotechnic composition including at least one aromatic polycarboxylic anhydride fuel component. In one embodiment of this composition, the pyrotechnic composition may have the property that combustion of the pyrotechnic composition produces a combustion product having a molecular ratio of $CO_2$ to $H_2O$ of greater than about 2.0. In another embodiment of this composition, the pyrotechnic composition may have the property that combustion of the pyrotechnic composition produces a combustion product having a molecular ratio of $CO_2$ to $H_2O$ of greater than about 4.0. In another embodiment of this composition, the pyrotechnic composition may have the property that combustion of the pyrotechnic composition produces infrared emissions having an output infrared color ratio of greater than about 1.0. In another embodiment of this composition, the pyrotechnic composition may have the property that combustion of the pyrotechnic composition produces a combustion product having a molecular ratio of $CO_2$ to $H_2O$ of greater than about 4.0. In yet still another embodiment of this composition, the pyrotechnic composition may have the property that combustion of the pyrotechnic composition produces infrared emissions having an output infrared color ratio of greater than about 1:1. In yet still another embodiment of this composition, the pyrotechnic composition may have the property that combustion of the pyrotechnic composition produces infrared emissions having an output infrared color ratio of greater than about 1:1 under windstream conditions of up to at least about Mach 0.75. In yet still another embodiment of this composition, the pyrotechnic composition may have the property that combustion of the pyrotechnic composition produces infrared emissions having an output infrared color ratio of greater than or equal to about 2:1 under windstream conditions of about Mach 0.2. In yet still another embodiment of this compostion, the fuel component may include at least one of benzene tetracarboxylic dianhydride, benzophenone tetracarboxylic dianhydride, benzene hexacarboxylic acid trianhydride, mellitic anhydride, or a mixture thereof The fuel component may include at least one of benzene tetracarboxylic dianhydride, benzophenone tetracarboxylic dianhydride, mellitic anhydride, or a mixture thereof. The fuel component may include benzene tetracarboxylic dianhydride. The fuel component may include benzophenone tetracarboxylic dianhydride. The fuel component may include benzene hexacarboxylic acid trianhydride. The fuel component may include one or more nitro functionalities. In another embodiment of this composition, the polycarboxylic anhydride may be present in a concentration of between about 8% and about 60% by weight of the pyrotechnic composition. This composition may also further include an oxidizing agent. This composition may also further include a binding agent. The binding agent may include at least one curable reactive resin. The oxidizing agent may include at least one alkali metal nitrate, perchlorate, or a mixture thereof. The oxidizing agent may be present in a concentration of between about 40% and about 90% by weight of the pyrotechnic composition. The binding agent may include at least one of an elastomeric polymer, epoxy resin, or a mixture thereof. The binding agent may be present in a concentration of between about 1% and about 20% by weight of the pyrotechnic composition. In one embodiment of this composition, the fuel component may be benzene tetracarboxylic acid dianhydride and the binding agent may be reactive with the fuel component. In another embodiment, the reactive binding agent may include epoxy resin. This pyrotechnic composition may have a shape that is maintained by the binding agent, and may further include an ignition layer surrounding at least a portion of the pyrotechnic composition. Further, this pyrotechnic composition may be configured as a decoy flare pellet, or adapted to be used as a propellant in an air bag deployment system.

In another respect, this invention is a pyrotechnic pellet comprising a pyrotechnic composition that may include from about 8% to about 60% by weight of an aromatic polycarboxylic anhydride fuel component, from about 40% to about 90% by weight of an oxidizing agent, from about 1% to about 20% by weight of a binding agent; and an ignition layer surrounding at least a portion of the pellet. The fuel component may include at least one of benzene tetracarboxylic dianhydride, benzophenone tetracarboxylic dianhydride, benzene hexacarboxylic acid trianhydride, mellitic anhydride, or a mixture thereof. The fuel component may include at least one of benzene tetracarboxylic dianhydride, benzophenone tetracarboxylic dianhydride, mellitic anhydride, or a mixture thereof. The fuel component may include benzene tetracarboxylic dianhydride. The fuel component may include from about 15% to about 38% benzene tetracarboxylic dianhydride. The fuel component may include benzophenone tetracarboxylic dianhydride. The fuel component may include benzene hexacarboxylic acid trianhydride. In one embodiment of this, the binding agent may be a reactive binding agent. For example, the aromatic carboxylic anhydride may be benzene tetracarboxylic acid dianhydride and the reactive binding agent may be epoxy resin. In another embodiment, the binding agent may include an elastomeric polymer. In another embodiment, the oxidizing agent may include at least one of an alkali metal nitrate, perchlorate, or a mixture thereof. In another embodiment of this pellet, the pyrotechnic composition may further include at least one of an antioxidant, conductive material, burning rate catalyst, or a mixture thereof. In still another embodiment, the fuel component may include from between about 20% and about 35% by weight benzene tetracarboxylic acid dianhydride or mellitic anhydride, the binding agent may include from about 2% to about 8% by weight synthetic rubber, and the oxidizing layer may include from about 60% to about 80% by weight potassium perchlorate. In yet still another embodiment, a pyrotechnic composition may have an afterburning stoichiometry, including an amount of oxidizing agent sufficient to supply between about 40% and about 95% of the stoichiometric amount of oxidizing agent required for complete combustion of the fuel component. In yet another embodiment, a pyrotechnic composition may have an afterburning stoichiometry, and include between about 28% and about 40% by weight of the fuel component, and between about 45% and about 69% by weight of the oxidizing agent. In still yet another embodiment, the pellet may be adapted to be received and combusted in a flare having a flare housing having one or more openings extending from an interior of the flare housing to an exterior of the flare housing, and in which the openings may be configured to allow partially oxidized combustion materials generated by partial oxidation of the fuel component within the flare housing to escape from the flare interior and to be further oxidized outside the flare housing. In still yet another embodiment, a pellet may be adapted to be received and combusted in an interior of a first flare housing of a flare, wherein the first flare housing may be coupled to a second flare housing having one or more outlet openings, wherein the first flare housing may have one or more openings extending from the interior of the first flare housing to an interior of the second flare housing and configured to allow partially oxidized combustion materials generated by oxidation of the fuel component within the first flare housing to escape from the first flare housing interior into the second flare housing interior, wherein the partially oxidized materials may be oxidized further within the second flare housing interior so that additional combustion materials are generated within the second flare housing, and wherein the second flare housing may have one or more outlet openings extending from the interior of the second flare housing to allow the original combustion materials and said additional combustion materials to escape and create a propellant force to propel the flare. The second flare housing may have one or more inlet openings adapted to allow oxygen containing gas into the interior of the second flare housing. In another embodiment, a pellet may be adapted to be received and combusted in a system for deploying air bags, the deployment system configured to allow combustion of materials generated by oxidation of the fuel component to inflate the airbag.

In yet another respect, this invention is a pyrotechnic composition for use in a system to deploy air bags, in which the pyrotechnic composition may have a fuel component with a molecular ratio of $CO_2$ to $H_2O$ of greater than about 1.0, and may have a flame temperature of less than or equal to about 1800° C. In one embodiment of this composition, the fuel component may include at least one of a mixed lactone polymer of hydroxyacetic acid, a mixed lactone polymer of lactic acid, a mixed lactone polymer of tartaric acid, maleic anhydride, phthalic anhydride, dicyandiamide, or a mixture thereof. In another embodiment, the pyrotechnic composition may further include a burning rate catalyst. In yet another embodiment, the pyrotechnic composition may include a fuel component including at least one aromatic polycarboxylic acid anhydride. The aromatic polycarboxylic anhydride may be any one of benzene tetracarboxylic acid dianhydride, benzophenone tetracarboxylic dianhydride, benzene hexacarboxylic acid trianhydride, or a mixture thereof. In another embodiment, the pyrotechnic composition may include a fuel component including anthraquinone.

In another respect, this invention is a decoy flare including a first flare housing having an interior and exterior and a pyrotechnic composition adapted to be received in the interior of the flare housing. The pyrotechnic composition may include from about 8% to about 60% by weight of an aromatic polycarboxylic anhydride fuel component, from about 40% to about 90% by weight of an oxidizing agent, from about 1% to about 20% by weight of a binding agent, and an ignition layer surrounding at least a portion of the pyrotechnic composition. The pyrotechnic composition may be formed in the shape of a pellet and adapted to be ejected from the first flare housing and simultaneously ignited. The pyrotechnic composition may also have an afterburning stoichiometry in which it may include an amount of oxidizing agent sufficient to supply between about 40% and about 95% of the stoichiometric amount of oxidizing agent required for complete combustion of the fuel component. In this regard, the pyrotechnic composition may include from about 28% to about 40% by weight of the fuel component and from about 45% to about 69% by weight of the oxidizing agent, and the first flare housing may have one or more openings extending from an interior of the first flare housing to an exterior of the first flare housing. These openings may be configured to allow partially oxidized combustion materials generated by partial oxidation of the fuel component within the flare housing to escape from the first flare housing interior and to be further oxidized outside the first flare housing. In another embodiment, the flare may further include a second flare housing having an interior and an exterior, and the first housing may be coupled to the second housing. In this embodiment, the pyrotechnic composition may have an afterburning stoichiometry and may include an amount of oxidizing agent sufficient to supply between about 40% and about 95% of the stoichiometric amount of oxidizing agent required for complete combustion of the fuel component. In this regard, the pyrotechnic composition may include from about 28% to about 40% by weight of the fuel component and from about 45% to about 69% by weight of the oxidizing agent, and the pyrotechnic composition may be adapted to be received and combusted in the interior of the first flare housing. Further, the first flare housing may have one or more outlet openings extending from the interior of the first flare housing to the interior of the second flare housing, and these openings may be configured to allow partially oxidized combustion materials generated by oxidation of the fuel component within the first flare housing to escape from the first flare housing interior into the second flare housing interior where the partially oxidized materials may be oxidized further within the second flare housing interior so that additional combustion materials are generated within the second flare housing. The second flare housing may have one or more outlet openings extending from the interior to the exterior of the second flare housing to allow the additional combustion materials to escape from the interior of the second flare housing so that a propellant force may be generated to propel the flare. In another embodiment, the second flare housing may have one or more inlet openings adapted to allow oxygen containing gas into the interior of the second flare housing. In another embodiment, the first flare housing may have one or more openings extending from an interior of the first flare housing to an exterior of the first flare housing, the openings configured to allow combustion materials generated by oxidation of the fuel component within the flare housing to escape from the flare interior so that a propellant force may be generated to propel the flare. In yet still another embodiment of this flare, combustion of the fuel component may produce a long to short infrared color ratio of greater than about 1.0. The flare housing may be adapted for use in an aircraft decoy flare deployment system. Combustion of the pyrotechnic composition may produce infrared emissions having an output infrared color ratio capable of decoying a missile having a seeker head configured to detect and distinguish color ratio of infrared emissions. In one embodiment, the decoy flare may include a pyrotechnic composition including an aromatic polycarboxylic anhydride that may be any one of benzene tetracarboxylic acid dianhydride, benzophenone tetracarboxylic dianhydride, benzene hexacarboxylic acid trianhydride, or a mixture thereof.

DESCRIPTION OF ILLUSTRATIVE EMBODIMENTS

Figure 3:
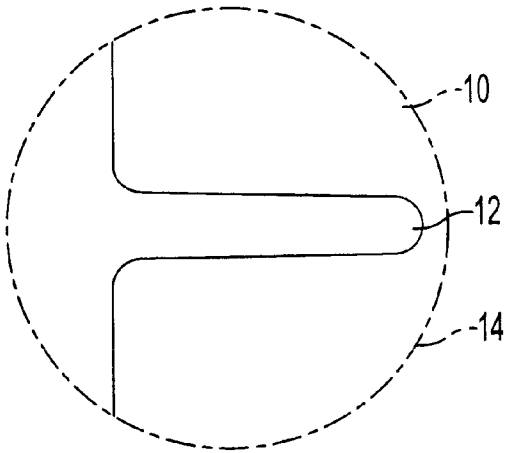
FIG. 3 shows an enlarged sectional view taken from FIG. 2 according to one embodiment of the disclosed method and apparatus.

Embodiments of the disclosed method and apparatus address past deficiencies by providing pyrotechnic compositions having combustion reaction products containing a relatively high percentage of carbon dioxide at high temperatures, for example, on the order of about 2300° K. As used herein, "pyrotechnic composition" refers to combustible compositions or mixtures of compositions that may be employed to emit radiation, such as to emit infrared radiation from a decoy flare or non-flare device, or which may be employed as a gas generating propellant, such as a rocket, flare, stores ejection, or airbag propellant. The composition may act as both IR source and propellant.

Although not wishing to be bound by theory, it is believed that by maximizing $CO_2$ output, the disclosed pyrotechnic compositions increase long wavelength IR emissions. At the same time, these compositions tend to minimize hydrogen-based outputs, such as from that water vapor, thereby minimizing short wavelength IR emissions. In addition, the disclosed pyrotechnic compositions minimize solid particle radiation and thereby prevent degradation of the desired color ratio. As used herein, long wavelength IR radiation is that commonly detected by a cooled indium antimonide detector having wavelengths in the 3–5 micron region of electromagnetic radiation. Short-wave IR radiation is that commonly detected with an uncooled lead sulfide detector having wavelengths in the 2–3 micron range. These two IR bands will be termed herein "LW" and "SW," respectively.

The disclosed pyrotechnic compositions comprise active fuel components that produce long IR wavelength to short IR wavelength color ratios typically of greater than about 1:1. Further, respective different embodiments of the disclosed compositions may produce infrared color ratios that are typically greater than about 1.5:1, typically greater than about 2:1, typically greater than about 3:1, typically greater than about 4:1, typically greater than about 5:1, typically greater than about 6:1, typically greater than about 7:1, typically greater than about 8:1, typically greater than about 9:1, and typically greater than about 10:1, respectively. An example of a composition producing an infrared color ratio greater than about 10:1 may be found in the pyrotechnic compostion embodiment of FIG. 7 of Example 1 (when burned under still air conditions). Advantageously, these favorable color ratios may be produced to a useful extent under static and/or windstream conditions such as those found when a decoy flare is ejected from a moving aircraft. As used herein "windstream conditions" means conditions in which a pyrotechnic composition is exposed to air or other gases in dynamic motion. In this regard the above-described color ratios may be typically achieved under a wide variety of dynamic conditions equal to and/or greater than Mach 0, such as those conditions experienced by a decoy flare when ejected from a jet aircraft. In respective different embodiments, the disclosed flare compositions may achieve the above described color ratios under windstream conditions of typically up to about Mach 2.0, typically up to about Mach 1.5, typically up to about Mach 1.0, and typically up to about Mach 0.85, respectively. Likewise, in other respective different embodiments, the disclosed flare compositions may achieve the above described color ratios under windstream conditions typically greater than about Mach 0, typically greater than about Mach 0.1, typically greater than about Mach 0.2, typically greater than about Mach 0.3, typically greater than about Mach 0.5, typically greater than or equal to about Mach 0.85, typically greater than about Mach 1.0, and typically greater than about Mach 2.0. respectively. In addition, still other respective embodiments of the disclosed flare compositions may achieve the above described color ratios under windstream conditions typically between about Mach 0 and about Mach 2.0, typically between about Mach 0.1 and about Mach 2.0, typically between about Mach 0.2 and about Mach 1.5, typically between about Mach 0.3 and about Mach 1.0, typically between about Mach 0.5 and about Mach 1.0, and typically at about Mach 0.85, respectively. In regard to the preceding, performance of a pyrotechnic composition may be evaluated or measured under such windstream conditions using any suitable method, for example, using methods and apparatus as described in Example 1.

In some embodiments, windstream LW/SW color ratios of the disclosed pyrotechnic compositions may decrease from still-air LW/SW values but typically remain relatively high and sufficient for successful employment in IR decoy applications. In addition, these pyrotechnic compositions tend to produce substantially non-toxic and non-corrosive gas products.

The disclosed pyrotechnic compositions may be employed in a variety of applications, including as a flare IR emission composition or a propellant composition. When utilized as a flare IR emission composition, the disclosed pyrotechnic composition may be employed in flares used to defeat a certain class of threats faced by aircraft, such as fighter, attack, reconnaissance, and cargo aircraft. When used as a propellant composition, the disclosed pyrotechnic composition may be employed as a propellant for flares or in other propellant applications such as for airbags, stores ejection, rockets, etc.

Embodiments of the disclosed method and apparatus offer a number of advantages that are apparent with benefit of the present disclosure. For example, in flare propellant embodiments, the disclosed compositions may act as both an IR source and a source of propulsion, to advantageously provide a relatively simple kinetic decoy that may be used to defeat certain modem IR-guided missiles. In expulsion propellant embodiments for the expulsion of stores, the disclosed pyrotechnic compositions advantageously tend to show desirably high thermal stability relative to other types of propellant compounds, such as nitrocellulose or double-base powder charges. Furthermore, the disclosed compositions may be utilized in expulsion propellant embodiments to produce substantially or completely oxidized gas, thereby substantially preventing undesirable atmospheric after-flash. In airbag propellant embodiments, the disclosed pyrotechnic compositions may be used as an airbag gas source which produces combustion products that tend to be low in water vapor and thus advantageously offer reduced propensity for causing vehicle occupant skin burns from water condensation upon airbag deployment. In such embodiments, the disclosed compositions also tend to be of low toxicity as compared, for example, to azide gas generator airbag compositions.

Besides an active fuel compound, embodiments of the disclosed pyrotechnic composition may also include oxidizing agents, binders, burning rate catalysts, antioxidants, and/or other accessory compounds. Still other embodiments of the disclosed method and apparatus include pyrotechnic compositions having an afterburning stoichiometry which allows for compositions comprising reduced amounts of oxidizing agent and increased amounts of active fuel component, thus providing, among other things, increased burn time. In those embodiments where minimized short-wave IR output is desired, it is typically desirable that increased levels of active fuel not give rise to exhaust gas particulate carbon, as this solid black-body radiator species may result in production of excessive short-wave IR output characteristics of a gray body at high temperatures.

Embodiments of the disclosed pyrotechnic composition may produce combustion reaction products containing some proportion of dissociated carbon dioxide (carbon monoxide plus oxygen) or of carbon monoxide. When used as a decoy flare emission composition, such carbon monoxide is typically present in small amounts. Combustion of the flare gas carbon monoxide to carbon dioxide with atmospheric oxygen typically tends to maintain a high flare gas plume temperature, thereby prolonging the emission of radiation. In a typical embodiment, the disclosed pyrotechnic composition includes an oxidizing agent for burning the active fuel material rapidly and at a high temperature without production of significant amounts of water vapor. A binder, typically chosen to minimize water vapor production, is also usually present. A thin ignition layer for rapidly igniting the disclosed pyrotechnic composition without adverse color ratio effects is typically provided on the surface of a grain of the disclosed pyrotechnic composition. Some of the grain surface may also be inhibited to control the radiation/time history of the grain.

In embodiments of the disclosed method and apparatus, pyrotechnic compositions are provided which include an active fuel component which produces a combustion product having a relatively high carbon and relatively low hydrogen content. In particular, such active fuel compositions are typically characterized by having combustion reaction products having a molecular ratio of $CO_2$ to $H_2O$ (water vapor) of about 1.0 or greater (for example, as measured in a flare output gas). More typically, these active fuel compositions are characterized by having a molecular ratio of $CO_2$ to $H_2O$ of greater than about 2.0, even more typically of greater than about 3.0, even more typically of greater than about 4.0, even more typically of greater than about 5.0, even more typically of greater than 6.0, even more typically of greater than about 7.0, even more typically of greater than about 8.0, even more typically of greater than about 9.0, and most typically of greater than about 10.0.

Classes of suitable active fuel component compositions include, but are not limited to, anhydrides (such as aromatic anhydrides or aliphatic anhydrides), polycyano compounds (both aromatic and aliphatic), quinones (including aromatic polynuclear quinones and anthraquinones), polylactones (including aliphatic polylactone polymers), acid salts, actyleneics (including conjugated diynes), polynuclear fused ring compounds (such as napthalenes, penantrenes and anthracenes), and mixtures thereof.

Examples of typical aromatic anhydrides include aromatic polyanhydrides and polymerized aromatic anhydrides. Examples of typical aliphatic anhydrides include aliphatic linear anhydrides and aliphatic (polyanhydride) polymers. Examples of typical quinones include p-quinone, p-quinone with two or less oxime groups per molecule, tetrachloro p-quinone, anthraquinone, nitrated quinones (mono- and dinitro-anthraquinone), dihydroxyanthraquinone, sulfonated anthraquinone derivatives (as metal salts). Examples of typical actyleneics include butynediol derivatives, butynediol esters and conjugate diynes. Examples of typical acid salts include K benzoate, anthranilate, K nitrobenzene, sulfonate, K acid phthalate, K salts of BTCA, and BPTCA parent acids. Examples of typical polynuclear fused ring compounds include dinitro and mononitro napthalene, phenanthrene, anthracene, and other complex systems (commonly used for dyes and pigments). Examples of typical aliphatic polylactone polymers include those polylactones having two or less linked methyl groups.

More typical active fuel components include aromatic polycarboxylic anhydrides, aliphatic polycarboxylic acid anhydrides, aliphatic or aromatic polynitriles, aromatic quinones or their derivatives, polynuclear aromatic compounds bearing one or more quinone groups or nitro groups, substituted acetylenic compounds, and mixtures thereof.

Examples of suitable aromatic polycarboxylic polyanhydrides, include, but are not limited to, benzene tetracarboxylic acid dianhydride ("BTCA", also known as pyromellitic acid dianhydride or "PMDA"), benzophenone tetracarboxylic acid dianhydride, mellitic acid anhydride, and benzene hexacarboxylic acid trianhydride. Other more typical anhydrides include, but are not limited to, aliphatic polycarboxylic acid mono- or poly-anhydrides or their derivatives, such as maleic anhydride and/or succinic anhydride and polymeric derivatives thereof. Still other examples of more typical active fuel components include, but are not limited to, hydroxyacid lactone polymers such as poly (hydroxyacetic acid), typically selected for their high carbon-to-hydrogen ratios as defined above. Still other examples include, but are not limited to, aliphatic or aromatic poly cyano compounds (such as nitrilotriacetonile, bis(nitrilodiacetonitrile) tetracyanopropane), malononitrile dimer, and poly-cyanobenzene isomers. Another more typical class of suitable fuels includes, but is not limited to, polynuclear aromatic compounds bearing one or more quinone, hydroxyl, carboxyl, anhydride, sulfonic acid, or nitro group per molecule.

In one more typical embodiment, an active fuel component may be an aromatic polycarboxylic anhydride ("APA"), a mixture of APA's, or a mixture including other compound/s and one or more APA compounds. In this regard, an APA may be any suitable aromatic acid anhydride including, but not limited to, any aromatic compound having one or more carboxylic acid anhydride functionalities. Although monoanhydrides may be employed in embodiments of the disclosed method and apparatus, multiple anhydride functionalities are typically employed. For example, in one embodiment benzene hexacarboxylic acid trianhydride is typically used. In another embodiment, benzene tetracarboxylic acid dianhydride, having only two hydrogen atoms per molecule, is employed. In another embodiment, benzophenone tetracarboxylic acid dianhydride ("BPTCA") with six hydrogens per molecule may be used.

In another more typical embodiment, an active fuel component may comprise a nitrated aromatic polycarboxylic anhydride ("NAPA"), a mixture of one or more NAPA's, or a mixture including other compounds and one or more NAPA compounds. In this regard, NAPA compound nitro groups offer the dual function of replacing hydrogen atoms and enhancing combustion, therefore reducing amounts of oxidizing agent required for optimum performance. For stability during processing the number of nitro groups may be limited to about one per contained benzene ring. Other desirable polycarboxylate anhydride derivatives may be employed alone, in mixture, or in mixture with other compounds including, but not limited to, stilbene derivatives, nitrated stilbene derivatives, and the like.

Another more typical embodiment employs aliphatic anhydrides, a mixture of one or more aliphatic anhydrides, or mixtures including other compound/s and one or more aliphatic anhydride compounds. In this regard, suitable aliphatic anhydrides are typically of low hydrogen content (less than about 2 hydrogen atoms per carbon atom) and, desirably, melting points of greater than about 100° C. Examples of suitable materials of this class include, but are not limited to, maleic anhydride ("MA"), succinic anhydride ("SA"), poly(maleic anhydride) and the like. It will be understood with benefit of this disclosure that such compounds may be reacted or otherwise treated to form derivative compounds offering improved properties, such as increased melting points or reduced hydrogen content, using any method known to those of skill in the art. For example, MA has a favorable molecular "C/H" ratio as described above of 4:1 but has a relatively low melting point of about 54–56° C. in the pure form. If desired, the utility of MA may be improved by reacting up to about 5 moles MA with each epoxy ring of a suitable aliphatic or aromatic diepoxide, thus forming a fuel with enhanced physical properties. Another example of a method to enhance the utility of MA is to react about 2 moles of MA or SA with about 1 mole of 1,4 butynediol to produce a diacid acetylenic ester. The hydrogen content of such a derived active fuel may be further reduced and the melting point further increased by forming a dipotassium or other metal salt of this material, with such metal being chosen as one substantially or completely volatile in the exhaust stream at composition reaction temperatures. This tends to have a beneficial effect on the burning rate of an active fuel component comprising MA or a similar succininc acid anhydride derivative when compounded as described below.

Other specific examples of more typical active fuel compounds include, but are not limited to, polycarboxylic anhydrides of mononuclear benzene derivatives, such as, trifluoromethyl benzene, benzoic acid, halogenated benzenes, phenol, and cyanobenzene(s); polynuclear aromatic compounds such as naphthalene, anthracene, and phenanthrene. Active fuels may include complex polynuclear or condensed-ring compounds such as those more commonly employed as dyes or pigments, including but not limited to, Anthraquinone series Vat Blue GCD, Golden Orange G, Vat Dark Blue BO, Celadon Jade Green, and the Indanthrene dye series Blue R, Yellow FRRK, Brown BR, and Khaki GG); aromatic ketones, including quinones such as anthraquinone, p-benzoquinone and its dioxime, heterocyclics such as pyridines; nitrated aromatics, including nitro or halo derivatives of aromatic polycarboxylic anhydrides, polynuclear derivatives mono and dinitronapthalene isomers; and nitrated aromatic quinones, such as mononitro and dinitroanthraquinones, and mixtures thereof.

Other more typical compounds include mono- or polynitriles such as poly (acrylonitrile), polycyano benzenes, aliphatic polynitriles such as malononitrile dimer (Lonza), tetracyanopropane, nitrilotriacetonitrile, bis-(nitrilodiacetonitrile), and ethylene diamine tetraacetonitrile. Such (poly)nitrilo compounds contain endothermic energy which tends to increase useful radiation without excessive formation of water vapor.

More typical triple bonded carbon compounds include 1,4 butynediol, methyl butyneol, and/or their derivatives having desirably low hydrogen content. Such acetyleneic materials have an acceptable C/H ratio and stored molecular energy to raise the flame temperature of compositions containing them. In a typical embodiment, butynediol may be modified for practical use by conversion to the tris(butynediol) borate, sulfate, phosphate or other low-hydrogen ester. The combustion products of the acid portion are typically chosen from a group which does not disadvantageously emit SW IR radiation or absorb LW radiation. Another typical method of utilizing butynediol is by reaction with BTCA to form the diacid di(butynediol) ester which may be used as such, or neutralized to form the dipotassium salt or other metal salt selected from the group above characterized by substantially complete volatility under flare operating conditions. Still another method of utilizing butynediol is by reaction with maleic anhydride to form the e diester diacid and using this as such, or by consequently forming an acceptable potassium or other volatile metal salt from that compound. Another suitable class of acetylenic active fuel compounds is formed by the oxidative coupling of materials such as propargyl alcohol or methy butynol. This class of active fuels is characterized by the presence of conjugated acetyleneic groups.

The disclosed pyrotechnic composition typically includes an active fuel component in a concentration that typically varies depending on the type or types of fuel components selected. Any concentration of active fuel components suitable for combustion may be employed; however, an active fuel component is typically present in a concentration of greater than about 8%, more typically greater than about 12%, and even more typically greater than about 15% by weight of pyrotechnic composition, and/or is typically present in a concentration of less than about 60%, more typically less than about 40%, and most typically less than about 38% by weight of pyrotechnic composition. Even more typically, an active fuel component is present in a concentration of from about 8% to about 60%, more typically in a concentration of from about 12% to about 40%, and most typically in a concentration of between about 15% and about 38% by weight of pyrotechnic composition. Although any form of active fuel component suitable for forming a pyrotechnic composition may be employed, an active fuel component is typically provided in the form of a powder. Active fuel component powders may comprise particles of any size and/or shape suitable for combustion, but typically range in a size of greater than about 3 $\mu$m, more typically greater than about 10 $\mu$m in diameter, and/or in a size of less than about 100 $\mu$m, more typically less than about 30 $\mu$m in diameter. Even more typically active fuel component particles range in size from about 3 $\mu$m to about 100 $\mu$m in diameter and most typically from about 10 $\mu$m to about 30 $\mu$m in diameter.

In the practice of the disclosed method and apparatus, an oxidizing agent may be present in any amount suitable for assisting combustion of an active fuel component. However, an oxidizing agent is typically present in an amount of greater than about 40%, more typically greater than about 50%, and even more typically greater than about 60% by weight of pyrotechnic composition, and/or is typically present in an amount of less than about 90%, more typically less than about 85%, and even more typically less than about 80% by weight of pyrotechnic composition. Even more typically, an oxidizing agent is present in an amount of from about 40% to about 90%, more typically from about 50% to about 85%, and most typically from about 60% to about 80% by weight of pyrotechnic composition. Oxidizing agents may be of a form similar to that described for active fuel components, namely powders or any other suitable form for forming a pyrotechnic composition mixture. However, an oxidizing agent typically comprises a powder having particles that range in a size of greater than about 3 $\mu$m, more typically greater than about 4 $\mu$m, and even more typically greater than about 5 $\mu$m in diameter, and/or typically range in size of less than about 200 $\mu$m, more typically less than about 80 $\mu$m, and even more typically less than about 44 $\mu$m in diameter. Even more typically, an oxidizing agent is a powder having particle diameters of from about 3 $\mu$m to about 200 $\mu$m, more typically from about 4 $\mu$m to about 80 $\mu$m, and most typically from about 5 $\mu$n to about 44 $\mu$m.

In some pyrotechnic composition embodiments, an oxidizing agent is typically employed so as to facilitate burning of an active fuel component rapidly and at a high temperature without production of significant amounts of solid gray-body radiating particles or of water vapor. In this capacity, oxidizing agents assist in combustion of carbon components of a pyrotechnic composition, thus helping ensure more complete combustion of such carbon compounds and reducing short wavelength IR radiation that may be produced by unburned carbon components of the flare exhaust gases. Suitable oxidizing agents include, but are not limited to, alkali metal nitrates, perchlorates, peroxides, or mixtures thereof. Specific examples of suitable oxidizing agents include, but are not limited to, potassium nitrate, potassium perchlorate, sodium nitrate, lithium nitrate or perchlorate, ammonium perchlorate, and cupric nitrate. Most typically potassium perchlorate is used.

A binder is typically used in the disclosed pyrotechnic composition embodiments in order to maintain a shaped pyrotechnic composition in a physical form that, for example, helps control combustion. Such a shaped pyrotechnic composition may be referred to as a "grain" and may be formed by any suitable shaping method known in the art including, but not limited to, pressing, molding, casting or extrusion techniques. A binder compound may also be selected to minimize water vapor production. Binders with a reduced potential for water vapor formation include fluorocarbons and fluorocarbon elastomers, chlorinated materials such as poly (vinyl chloride or vinylidene chloride) copolymers, polyacrylonitrile copolymers, poly lactones such as poly (hydroxyacetic/lactic acid), and polyesters such as poly(triethylene glycol) succinate. Typically binders with reduced hydrogen content are chosen, if possible.

A binder may be applied to or admixed with the other components of the pyrotechnic composition in any suitable manner, including as a fluid, subdivided solid, dispersion, or solution. In this capacity, a binder allows shaping or forming of a pyrotechnic composition into a solid mass that is typically substantially nonporous. A binder also typically helps supply the necessary physical integrity required to help survive vibration and other disruptive forces that may occur, for example, during or after decoy flare launching. Such forces may tend to cause flare grain disintegration, such as cracking and/or crumbling.

In the practice of the disclosed method and apparatus, a binder may be nonreactive, reactive, or a mixture thereof. A nonreactive binder may be any suitable material that is nonreactive with itself or other components of the pyrotechnic composition and which is suitable for maintaining the composition in a desired shape. Suitable nonreactive binders include, but are not limited to, elastomeric polymers, plasticized thermoplastic or thermoset polymers, high-oxygen polyesters, fluoroelastomers, chlorinated copolymers, poly lactones, and polyanhydrides. Alkylene carbonates such as ethylene or propylene carbonates may desirably be employed as plasticizers in combination with such nonreactive binders or mixtures thereof. Specific examples of suitable nonreactive binders include, but are not limited to, nonreactive elastomer materials including synthetic elastomers such as "KRATON" (available from Shell Chemical Company), fluoroelastomers such as "VITON" copolymers (available from DuPont), or plasticized Halar (polyvinylidene fluoride) polymers or copolymers with or without added acrylic or methacrylic modifiers (available from Ausimont USA). Plasticizers for Halar may include low-volatility polar esters such as those from mellitic acid, phthalic acid, or BTCA acid, alkylene carbonates, neopentyl glycol polyadipate (or other suitable plasticizers known to those skilled in the art as effective or latent PVC plasticizers), or "Kel-F" chlorotrifluorocarbon oils. Optionally an elastomeric binder may be employed which is a condensation product of formaldehyde and an alkylated phenol or alkylated resorcinol, such as that from tert-butyl phenol (available from Schenectady Chemical Co.)

Nonreactive elastomer binder materials are typically applied as a solution or as a micronized powder or dispersion in a fluid nonsolvent for the major components or a pasty admixture of micronized resin plus latent plasticizer. This latter mixture may also include a vaporizable fluid nonsolvent for the active fuel component(s), whose function is to aid even dispersion and incorporation of the binder.

A non-reactive binder may be utilized in any amount suitable for maintaining the shape and/or integrity of a shaped pyrotechnic composition. Typically, a non-reactive binder is employed in a concentration of greater than about 1%, more typically greater than about 2%, and most typically greater than about 3% and/or in a concentration typically less than about 20%, more typically less than about 12% and most typically less than about 8% by weight of the pyrotechnic composition. Even more typically a non-reactive binder is employed in an concentration of between about 1 and about 20%, more typically between about 2% and about 12%, and most typically between about 3% and about 8% by weight of the pyrotechnic composition. Compositions having non-reactive binders may advantageously be pressed or extruded at ambient or elevated temperatures (i.e., at about 60° C. to about 160° C.). Optimum forming conditions may also include the application of vacuum (i.e., from about 4 to about 29.9 inches mercury vacuum) to remove air or other gas from the composition before or during compaction.

In another embodiment, any binder mixture that is suitably self-reactive or partially reactive with an active fuel component of a pyrotechnic composition may be utilized. Reactive binders include, but are not limited to, hydroxy terminated polybutadiene, epoxidized polybutadiene, epoxidized vegetable oils, amine-terminated polyethylene glycols, fluorocarbon diols, poly glycidyl azide diols, hydroxy-terminated triethylene glycol succinate polyesters, polyethylene/polypropylene glycol copolymers, or ethylene oxide/propylene oxide adducts of sucrose or pentaerythritol or mixtures thereof. For example, a reactive binder may be an epoxy compound such as epoxidized hydroxy terminated polybutadiene ("HTPD") (available from Elf Atochem North America) or "EPOXOL 9-5", (available from American Chemical Service Inc.) in combination with a curing catalyst. Suitable curing catalysts include, but are not limited to, chromium octoate, "HYCAT-2000" chromium complex catalyst (available from Dimension Technology Chemical Systems), organosoluble zinc compounds or zinc complexes, tetrabutyl titanate or other titanates, boric oxide, and other catalysts known to accelerate the anhydride-epoxy reaction. If a reactive binder is chosen which chemically bonds to the surface of the active fuel particles, the mixture typically need not be heated sufficiently to dissolve the anhydride component such as is common practice, for example, in the manufacture of adhesive or film polymers. In such an embodiment an active fuel compound may act whole or in part as a curing agent for a reactive binder, thus resulting in a pyrotechnic composition comprising BTCA or another active fuel component in a solid matrix of cured binder.

Other reactive binders which do not react substantially exclusively with the surface of a polyanhydride fuel are also suitable. Most typically binder materials that are flexible, rather than brittle or inelastic, in the cured form are employed. Examples of such suitable reactive binders include, but are not limited to, curable silicone rubbers, curable polysulfide elastomers, mixtures of dimer acid plus epoxidized vegetable oil, mixtures of aliphatic diepoxides plus poly(triethylene glycol succinate), polymeric polymercaptan/DEGBA mixtures with or without isostearic or other acid cure rate modifiers, two-component urethanes resistant to gas formation in contact with anhydrides, glycidyl azide polymer materials, epoxidized HTPD plus appropriate curing agents, maleic anhydride-modified HTPD (available from Ricon Resins Corp.) plus appropriate curing agents, resorcinol or phenol formaldehyde resins modified with nitrile rubbers, furfural or polyvinyl butyral, or acrylic-terminated peroxide-cure resins with resilient polyurethane central blocks. Other reactive binders may be chosen by one skilled in the art in view of the above. It is understood with benefit of this disclosure that curing agents, property modifiers and stabilizers may also be optionally included with the binder mixtures as necessary or desired for each reactive mixture of meet the requirements for IR output intensity, color ratio, safety, physical properties, burning rate, stability, and temperature resistance of the finished pyrotechnic composition.

Any suitable amount of reactive binder may be employed. Typically a reactive binder is present in the same concentration ranges as mentioned above for non-reactive binders. In a most typical embodiment employing a reactive binder, a pyrotechnic composition comprises about 4% by weight of a flexiblized curable resin mixed with about 26% by weight of an active fuel compound such as BTCA.

In the practice of the disclosed method and apparatus, a solvent may be employed during production of a shaped pyrotechnic composition or grain to assist in the mixing of an active fuel component and a binder. Such a solvent is typically selected to help ensure that a binder is distributed over the surfaces of the active fuel and oxidizer components. In this capacity, any solvent suitable for solubilizing the selected binder composition may be employed including, but not limited to, hexane, pentane, cyclohexane, amyl acetate, toluene, xylene, Stoddard solvent, methyl t-butyl ether, methyl t-amyl ether, supercritical fluids, and/or mixtures thereof. Most typically, a solvent that does not dissolve and/or react with the active fuel component is typically employed. This helps maintain a desired small and uniform fuel particle size, and therefore uniformity of the fuel composition burn rate. In addition, such maintained particle size characteristic substantially improves the subject composition's relative insensitivity to the ill effects of windstream action on IR color ratio.

When a solvent is used, it is typically evaporated by the action of vacuum, warm dry air flow or warm inert gas flow after mixing an active fuel component, oxidizer, and binder. A binder may also be "shock gelled" by the addition of a nonsolvent or emulsion-breaking agent to the stirred suspension of ingredients in binder solution or nonpolar emulsion binder form. A nonsolvent or emulsion-breaking agent is typically chosen so as not to adversely affect the proportion, particle size or chemical purity of the active fuel or oxidizer. A nonsolvent is also typically selected so that it does not remove or destroy auxiliary ingredients such as antioxidants, dispersants, etc. that are desired to be in the finished composition. As in all embodiments of the disclosed method and apparatus, processing is typically performed in the absence of moisture due to the reactivity of moisture with anhydrides. Absence of moisture has less effect on other classes of active fuels mentioned, but is still typical due to detrimental effects on the particle size of the oxydizer component which usually occurs. Following solvent or fluid phase separation and/or evaporation, the binder coated pyrotechnic composition particles may be shaped, typically by pressing. However other methods of shaping, such as extrusion and molding may also be employed. Another embodiment of forming the disclosed composition grains is to press, cast or otherwise produce a preform of composition still substantially damp with process fluid, remove such process fluid by any suitable method as above, and then compact or extrude such preform. This action may be advantageously accomplished in a case or other housing desired to surround or maintain the pyrotechnic grain in the final finished article.

During pressing, thin films of binder (such as uncured resin which coats the composition particles) may act as a temporary lubricant in aiding formation of a substantially imporous grain and additionally as a adhesive to effect bond between the pyrotechnic grain and surrounding or supporting members. Once pressed or otherwise shaped, a pyrotechnic composition is typically maintained in a desired shape while the binder material cures or otherwise solidifies. In the case of a reactive binding agent, curing of the binder may be accomplished in any suitable manner. Typically, curing is accomplished either at room temperature (such as at a temperature of between about 60° F. and about 95° F., most typically about 70° F.), or at a slightly elevated temperature between about 120° F. and about 200° F., most typically about 140° F.).

Although one embodiment of forming a shaped pyrotechnic composition using a binder has been described above, it will be understood with benefit of the present disclosure that other methods may be employed. Furthermore, it will be understood that when a resin reactive binder is utilized, varying types and concentrations of reactive resins may be employed, and separate appropriate curing agents known to those of skill in the art may be utilized.

In the practice of the disclosed method and apparatus, accessory materials are also typically added to a pyrotechnic composition. For example, antioxidants may be added to protect materials such as unsaturated synthetic rubber binders, from oxidizing and becoming brittle. In this regard, any suitable antioxidant known in the art may be employed. An antioxidant such as "IRGANOX 1010" (available from Ciba-Geigy Corp.) is typically employed with a synthetic rubber binder such as "KRATON". Other suitable antioxidants include, but are not limited to, hindered amines, BHT, BHA, zinc dibutyl dithiocarbamate, and other antioxidants in use as polymer stabilizers. If ultraviolet light exposure is foreseen during manufacture or as a side effect of curing adhesives in the final assembly by UV light, UV stabilizers such as triazoles and hydroxy benzophenones may be added to the composition. If copper or other catalytic metal compounds are employed as burning rate modifiers, suitable chelating agents may be employed to increase the stability of the binder. Typical concentration of antioxidant or stabilizer is from about 0.01% to about 2%, more typically from about 0.1% to about 1%, and most typically between about 0.2% and about 0.8% by weight of a pyrotechnic composition.

Conductive materials, such as carbon black or graphite, may also be added to a pyrotechnic composition to increase electrical conductivity. Any compatible conductive material may be employed that is suitable to substantially prevent or reduce the formation of static electricity charges which typically occur when processing very dry and fine nonconductive powders, such as BTCA powder particles which are used in some embodiments of the disclosed method and apparatus. These static charges tend to form on the surface of powder particles, and may result in separate particles of powder. becoming electrified and mobile with respect to each other. This phenomenon tends to increase difficulties in handling and under some conditions, may induce accidental ignition of the composition during mixing or fabrication. When used to enhance conductivity, an additive such as carbon black or amorphous carbon may also be selected to offer the additional advantage of increasing the burning rate of a pyrotechnic composition. When employed as an accessory material in the practice of the disclosed method and apparatus, a conductor is typically added at a concentration of between about 0.1% and about 5%, more typically between about 0.2% and about 2%, and most typically between about 0.25% and about 1% by weight of a pyrotechnic composition.

Another possible additive to the disclosed pyrotechnic compositions are fine reinforcing fibers, which may be dispersed in the pyrotechnic composition in such proportion as may advantageously enhance the physical and safety aspects of the product. The finely-divided fibers are of such nature that they are substantially consumed in a pyrotechnic reaction and minimize presentation of black or gray-body radiators to the view of a missile seeker. In such embodiments, oxidizer content of a protective composition may be slightly increased to ensure substantially complete combustion or destruction of the added fibers. Such fibers are typically employed in proportions of about 0.1% to about 3%, though amounts less than about 0.1% and greater than about 3% are also possible. Suitable fibers include, but are not limited to those of high-tenacity polyester, cellulose or cellulosic derivative, polyamide, polyolefin, polyacrylonitrile, Rayon, acrylic copolymers and mixture thereof. The fibers may be reduced in length to facilitate incorporation if desired, such as to a fiber length of about 1/8 to about 1/16 inch. The surface of such reinforcing fibers may be chemically modified by oxidation or by coating with a bonding or coupling agent to increase the bond strength to the chosen grain binder. Among such typical coupling agents may be mentioned titanate compounds "KR TTS", "KR 134", "KR 138S", "LICA 01" and "LICA 12" (Kenrich Petrochemical Corp.) and various suitable organosilanes.

Burning rate catalysts may also be employed as accessory materials in the practice of the disclosed method and apparatus. A burning rate catalyst may include any suitable pyrotechnic burning rate catalyst known to those of skill in the art. Typically, burning catalysts include materials capable of increasing the burning rate, ignitability and/or optionally modifying the burning rate exponent (i.e., the slope of burn rate of the compacted composition versus pressure). Such a catalyst and/or its residues may also aid in the oxidation of carbon particles which may escape the main oxidation reaction. Such materials include, but are not limited to, potassium benzoate, potassium hydrogen phthalate, potassium picrate, potassium picramate, potassium sulfanilate, potassium nitrobenzene sulfonate, p-benzoquinone monoxime or dioxime, amorphous carbon, silicone resins, potassium dinitrobenzoate, Red Gum or other condensed hydroxybenzene compounds, copper or cerium oxides or acetylacetonates, manganese octoate, copper chromite, and mixtures thereof. Another suitable method for controlling burning rate includes coating the oxidizer and/or fuel particles with an adsorbed film of organo-titanate or organo-zirconate coupling agents, such as "KR-38S", "KR-238", "LICA 12", and/or "LICA 38" (available from Kenrich Petrochemicals). Typically, application rate of titanate/zirconate compounds varies from about 0.05% to about 0.6% by weight, though amounts less than about 0.05% and greater than about 0.6% are also possible. In such embodiments, this molecular film may also serve as a dispersant and coupling agent between the fuel/oxidizer particles and the binder. In this regard, a burning rate catalyst or mixture of catalysts may be selected by those of skill in the art to vary burning performance of a pyrotechnic composition to meet requirements for a particular application. In the practice of the disclosed method and apparatus, burning catalysts may be employed in any amount sufficient to control burning rate, typically from about 0.1% to about 6%, more typically from about 0.5% to about 4%, and most typically between about 1% and about 3% by weight of a pyrotechnic composition.

Other accessory materials that may be employed include any suitable mold release agent known in the art. For example, mold release agents such as "ACRAWAX C ATOMIZED" (available from Lonza Inc.), polytetrofluroethylene ("PTFE") powders, zinc or calcium stearates, low molecular weight polyolefin powders or dispersions, pentaerythritol tetrastearate, or mixtures thereof may be used. Mold release agents may be employed in any suitable concentration, but typically in a concentration of from about 0.05% to about 2%, more typically from about 0.1% to about 1%, and most typically between about 0.2% and about 0.6% by weight of a pyrotechnic composition.

Dispersants may also be added to a powder/solvent mixture to reduce agglomeration tendency of individual particles during processing. In this capacity, a dispersant tends to disperse and subdivide individual active fuel/additive/oxidizer agglomerates and thus to increase their degree of intimate incorporation. The agents also have utility as a coupling agents, increasing the practical utility of the bond between polymeric binder and active fuel and or oxidizer particles. A dispersing also tends to reduce the apparent viscosity of a powder/solvent mixture, and consequently the amount of solvent required to process. such mixtures. For example, pyrotechnic composition solutions containing "KRATON" rubber binder and cyclohexane solvent tend to be nonpolar in nature. Individual polar particles in these solutions tend to form polar networks and to agglomerate. Such solutions typically require relatively large concentrations of solvent to form a slurry suitable for processing. In this regard, any suitable dispersant may be added to reduce the solution viscosity and the tendency toward particle agglomeration. Suitable dispersing agents include, but are not limited to, organotitanates, lecithin, complete or partial fatty acid esters of polyhydroxy compounds, soluble fluorocarbon materials containing integral polar molecular entities, the alkylamine adducts of dimer acid, alkylated polyvinyl pyrrolidines, cationic surfactants such as lauryl pyridinium chloride, ethoxylated soya amine, "TRITON X-400" quaternary chloride (available from Rohm and Haas), certain copolymers of ethylene and propylene oxide, alkyl polyoxyalkylene phosphates, and "SURFYNOL 104" tertiary acetylenic glycol (available from Air Products).

When used, dispersants having molecular regions differing in polarity also have unexpected favorable effects in the finished product. In this regard, a composition containing a typical dispersant ("GANEX V220", ISC), typically presses to high uniform density more easily, has greater strength and a better surface finish, a slightly higher burning rate, and a more favorable color ratio than the same composition without such a dispersant. Other favorable effects of an effective dispersant on composition function include an increased IR output intensity and a reduced sensitivity to the detrimental effects of windstream on IR color ratio. Specific examples of suitable dispersant agents include, but are not limited to, alkylated polyvinyl pyrrolidines, such as "GANEX V220" (available from ISP). Also suitable as dispersants are phospholipids such as lecithin, a specific example of which is "CENTROLEX P" (available from Central Soy Products). Still other specific suitable dispersing agents include, but are not limited to, organic titanates, such as "KR-38S", "KR-238", "LICA 12", and "LICA 38" (available from Kenrich Petrochemicals). Although any suitable concentration may be used, dispersant agents are typically employed at a concentration of between about 0.01% and about 3%, more typically between about 0.05% and about 1.5%, and most typically between about 0.1% and about 1% by weight of pyrotechnic composition.

A typical embodiment of the components of the disclosed pyrotechnic composition is listed in Table 1. Table 1 also lists a typical embodiment of a mixing solvent employed in the mixing of components of the disclosed pyrotechnic composition.

TABLE 1

| Typical Pyrotechnic Composition | |
|---|---|
| Additive Compounds (Total 100%) | |
| Silica flow aid | about 0%–1% |
| Conductive carbon | about 0%–1% |

TABLE 1-continued

| Typical Pyrotechnic Composition | |
|---|---|
| Potassium Perchlorate | about 60%–80% |
| Polycarboxylic Acid Derivative | about 20%–30% |
| (optionally | about 20%–35%) |
| Binder | about 2%–8% |
| Mixing Solution (Per Weight of Additive Compounds) | |
| Amyl Acetate | about 30%–40% |
| Hexane | about 100%–400% |
| Cyclohexane | about 100%–400% |

In a typical embodiment of the disclosed method and apparatus an ignition layer is typically applied to the surface of a shaped pyrotechnic composition or grain to rapidly ignite the composition without adverse color ratio effects. A typical ignition layer is thin, compared to the dimensions of the grain, being applied by brushing or dipping. Suitable materials for use as ignition layers include materials and mixtures of materials chosen to offer high burning temperatures, high burning rates, safety and adhesion, in addition to low short wavelength IR emissions during burning. Suitable ignition layer compositions include any ignition layer composition known in the art. These include but are not limited to compounds such as boron potassium nitrate, boron-potassium perchlorate-binder, or modified versions of the composition of the main pyrotechnic grain, or mixtures thereof. Typically an ignition layer includes a mixture of from about 40% to about 80% potassium nitrate or perchlorate oxidizer, about 10% to about 25% boron fuel, about 0% to about 15% polytetrafluoroethylene ("PTFE") powder, about 0% to about 10% siliceous thixotropy modifier, about 4% to about 15% soluble fluoroelastomer binder, and about 0% to about 1% process and/or application aids (such as Ganex "V220", Carbazole Violet pigment, and/or silica-alumina aerogel ("DEGUSSA") or wetting agents.

A typical embodiment of an ignition layer material is shown in Table 2.

TABLE 2

| Ignition Layer Composition, Weight Percentages | |
|---|---|
| PTFE (mixed fine particle grades) | about 11% |
| "VITON A" or "A200" (DuPont) | about 12% |
| Potassium Perchlorate (100 mesh) | about 61.5% |
| Boron (90–92%) | about 14.5% |
| Carbazole Violet pigment | about 1.0% |
| Butyl acetate solvent | (as needed) |

In the practice of the disclosed method and apparatus, a thin slurry of ignition layer material in organic solvent is typically painted, dipped or sprayed onto the surface of a shaped pyrotechnic composition, and the surface allowed to dry. As so used, the thin ignition layer burns rapidly when ignited and serves to ignite the pyrotechnic composition surface lying beneath it. In addition, the thin ignition layer may be selected to serve as a sealant on the pyrotechnic composition surface, protecting the composition against unwanted water absorption or other effects detrimental to successful function during manufacture and device assembly.

In some embodiments of the disclosed method and apparatus, a pyrotechnic pellet or grain surface may be inhibited to some extent to control the operating time/intensity and/or time/thrust profile for particular applications. Such surface inhibitors include any surface coating materials suitable for the purpose and known to those skilled in the art, such as: silicone rubber with or without fillers (example: "SILASTIC E", available from Dow Corning), fiber reinforced aluminum tape (available from 3M), polyimide tape with pressure-sensitive adhesive ("KAPTON", available from DuPont), HTPB-isocyanate rubber-catalyst, crosslinked filled "VITON" sheet silicone adhesive, a slurry of "VITON" with ceramic microballoons and with or without amine curative, and phenolic resin plus silica or carbon fillers wholly or partially crosslinked.

The formulation and application of the surface burning inhibitor is typically optimized so as not to allow the release of excessive solid glowing particles which have ill effects as described above. A major or minor proportion of the inhibitor may be one of the active fuels mentioned above, typically chosen to have sufficient molecular oxygen to ablate without forming hot carbon particles. An inhibitor may also contain a minor proportion of oxidizing agent so as to make it slowly combustible while, at the same time, filling the need for effective protection of the underlying pyrotechnic from uncontrolled ignition. A layer or body of inhibitor may also extend from the grain surface or surfaces to an adjacent interior of a case, so as to protect the case and any associated gas release nozzles from the destructive effects of hot combustion gases and to aid in the bond between grain and body. Another purpose of the described inhibitor is the provision of a relatively cool annulus or sheath of gas, being disposed around the main working flame display agency. Such a gaseous sheath may serve to prevent the premature cooling of the flame by admixture with cold ambient air. In a typical embodiment silicone rubber with or without fibrous heat-resisting filler is employed. A gas-forming fuel admixture, such as a powdered poly(hydroxyacetic acid/lactic acid) copolymer, may also be compounded with this or other suitable binder.

Decoy Flare Embodiments

The disclosed pyrotechnic compositions may be used, among other things, in individual decoy flares, or sets of such flares. As used herein, the term "decoy flare" is used to designate a countermeasure decoy having an IR output designed to confuse, decoy, or otherwise defeat a missile with an IR seeking head. Such flares may be employed in various applications including, but not limited to, those applications directed to the protection of various types of aircraft, ships, or tanks from heat seeking or IR seeking devices.

In a typical embodiment of the disclosed method and apparatus, a pyrotechnic composition is typically pressed, molded or otherwise shaped into the form of one or more grains, such as pellets, for use in a decoy flare or other suitable device. Typically, a pellet is of a dimension such that a single pellet may be utilized in a single flare device. Such a pellet may be employed in internal or external burning applications. By "internal burning" it is meant that a pellet is launched into the airstream within a heat-resistant housing or case and that the pellet is ignited and burns within the housing or case in such a way that burning gases are expelled from the housing or case. By "external burning" it is meant that a pellet is ignited and launched essentially uncovered into the airstream, where it burns in an essentially exposed condition. Typically such an external burning pellet is launched from a housing or cartridge case in which it is initially contained. To launch an external burning pellet from the aircraft, a charge of propellant powder is typically employed to launch the pellet or housing and pellet or pellets from the cartridge case. The unit, or units, therein are ignited to function after a short controllable interval so that the carrying vehicle is not harmed and the desired infrared display is produced.

In one embodiment, a multiplicity of grains, shaped volumes or densified granules of the subject pyrotechnic may be employed in a single decoy unit cartridge. The subgrains may be pre-formed or formed at the moment of decoy ejection by the controlled disintegration of larger sheets or bodies containing features to control their fracture. Each subgrain may be furnished with ignition material as defined above. Such multiplicity of grains, however formed, may be employed to provide a disperse glowing volume or elongate trail of miniature IR sources of the proper color ratio. The high air drag/mass ratio causes such subgrains to decelerate more rapidly than one larger grain, which is an advantage in certain tactical situations.

The smaller grains may be enclosed and disposed within an enveloping resilient mass of pyrotechnic mass of pyrotechnic material which support and consecutively, or nearly instantaneously, releases them. The enveloping mass protects the preformed grains from shock and abrasion, so as to avoid the production of fines during vibration or shock conditions. Fines are less effective as controlled IR energy sources and may induce hazardous conditions on firing. The burning or flame-erosion rate of the enveloping, supporting material may be varied over a wide range. The supporting material may serve as an ignition layer to the subunits. Preferably the supporting material is in the form of a foam, of the syntactic or chemically foamed varieties, which may contain some proportion of oxidizing agent to aid in grain ignition and release. The foam may be bonded to the subgrains by the action of setting, evaporation or polymerization in situ. Alternatively the support material may surround the grains but not adhere to them, due to a nonbond condition existing between the support and the surface of the subgrains. Such a condition aids flame transfer and clean release of the grains from the burning or eroding mass.

In an alternative embodiment employing a multiplicity of smaller grains, the grains may be enclosed singly or multiply in individual flame-resistant housings provided with one or a multiplicity of nozzles, so that some measure of self-propulsion or active dispersion is realized. The housed subgrains may be provided with some means of aerodynamic stabilization so that air drag may be minimized and the housed subgrains accompany the launching aircraft along its trajectory for some short interval.

Aerodynamic stabilization may be provided by fins, center-of-gravity ("COG") placement, or spin (gyroscopic) action. In one embodiment of spin stabilization, the exhaust jet(s) responsible for attaining a stabilizing spin rate of may be arranged so that their IR output is periodically obscured by the body of the unit or an affixed extension, giving rise to a flickering IR pulse form that may prove advantageous in defeating some seeker mechanisms.

Figure 1:
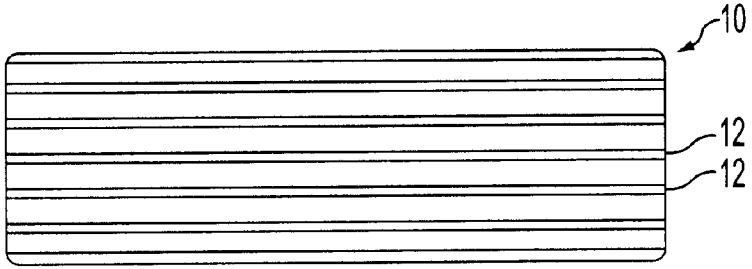
FIG. 1 shows a side view of a pyrotechnic pellet according to one embodiment of the disclosed method and apparatus.
Figure 2:
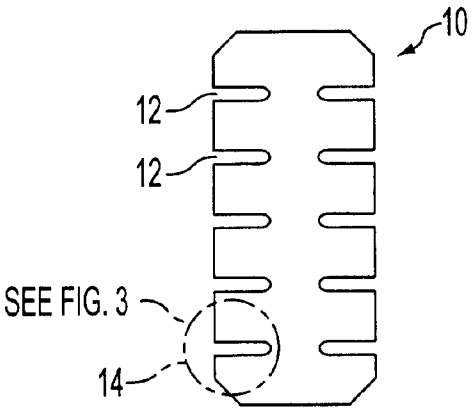
FIG. 2 shows a cross-sectional view of a pyrotechnic pellet according to one embodiment of the disclosed method and apparatus.

FIG. 1 is a side view of a typical pressed flare pellet 10 of the disclosed method and apparatus, such as for use in an aircraft decoy flare. In one embodiment, pellet 10 weights about 300 g and has a pellet density of about 2.0 g/cm$^3$. FIG. 2 is a side view of the pellet of this embodiment, while FIG. 3 is an expanded representation of section 14 of FIG. 2, showing grooves 12 which are formed in the longitudinal sides of pellet 10. Although a pellet of particular dimensions and proportions is illustrated in FIGS. 1–3, it will be understood with benefit of this disclosure that pellets having any other suitable shape and dimensions are also possible. It will also be understood that the disclosed method and apparatus may be employed in decoy flare applications systems for various types of aircraft or other vehicles.

Although FIGS. 1–3 illustrate one embodiment of a pellet configuration of the disclosed method and apparatus, it will be understood with benefit of the present disclosure that a variety of other pellet or grain embodiments may be practiced using the disclosed pyrotechnic composition. For example, pellets or grains having one or more internal, externally-vented cavities, a smooth cylindrical exterior, cuts through the mass of the pellet, a spaced array of concave or convex dimples, concentric inset ring-shaped cavities, and/or axially continuous exterior ridges protruding above the main grain surface are also possible. The multiple subgrains referred to above may be shaped as discs with or without indentations or protrusions on the flat surfaces so as to space the grain surfaces controllably and allow the rapid transmission of igniting flame. Another suitable composition shape includes hexagonal or octagonal prisms with or without a central perforation or symmetrically disposed multiple axial perforations.

The perforations in such grains need not be continuous from one surface to another. Pellet or grain shapes may include any such shapes known to those of skill in the art. In addition, it will be understood with benefit of the present disclosure that non-pelletized forms of the pyrotechnic composition of the disclosed method and apparatus may be used, including powder, granules, spheres, flattened spheres, etc.

Although not necessary to obtain benefits of the disclosed method and apparatus, when the disclosed pyrotechnic composition is employed in a decoy flare, the components of the composition are typically proportioned to achieve a long to short wavelength IR color ratio of greater than about 1:1, more typically greater than about 1.5:1, and most typically greater than about 2:1 when measured under windstream conditions in the velocity range of utilization. In this regard, adjustment of color ratio may be accomplished by, among other things, changing the main active fuel/oxidizer ratio, changing to or admixing another main active fuel of a different structure and burning behavior, changing the nature or proportions of the binder component, and/or adding some proportion of a fuel or catalyst which acts as color ratio and/or as a flame temperature modifier. This latter class of modifiers includes, but is not limited to, amorphous boron, amorphous or substantially noncrystalline carbon, or boron in a combined state in intimate admixture or chemically-bound form with one or more fuels.

Propellant Embodiments

Figure 4:
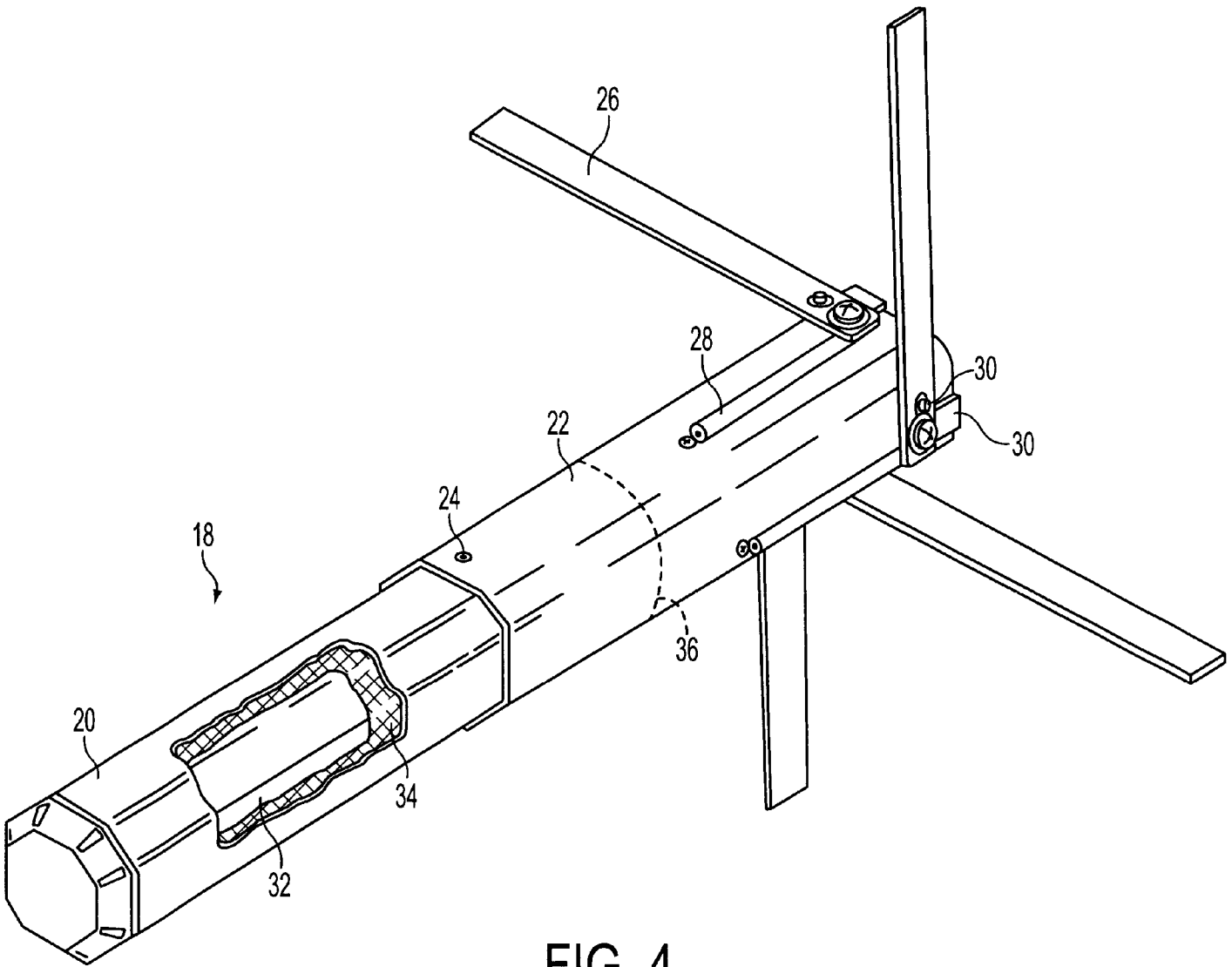
FIG. 4 is an illustration of a flare decoy having a pyrotechnic pellet according to one embodiment of the disclosed method and apparatus.

A pyrotechnic composition of the disclosed method and apparatus may be employed as a propellant, such as in the form of a pressed pyrotechnic grain inside a housing or cartridge. Typically such housings are configured so as to direct gas pressure generated from the burning pyrotechnic composition so as to propel the housing through the air. This may be done, for example, using one or more rocket nozzles positioned in the base of a housing, through which combustion gases exit, thereby propelling the housing forward. FIG. 4 illustrates a decoy flare 18 configured in one such possible propellant embodiment. In FIG. 4, the decoy flare comprises an internally perforated pyrotechnic grain 32 that is comprised of the disclosed pyrotechnic composition, surrounded by an inhibitor layer 34 and contained in a case 20. The grain may be formed as one unit or as two halves, adhered together with the aid of a composition approximating the inhibitor mixtures above, and chosen for strong adhesion to the pressed composition surfaces. In this embodiment, a shroud 22 is slidably mounted around case 20 and is capable of sliding from a position coextensive with case 20 toward one end of the case upon flare launching (energized by air drag, gas pressure, stored mechanical energy or propulsion force), thus causing optional fins 26 to deploy. In this regard shroud 22 locks into position by means of shroud lock 24, and the travel of fins 26 during deployment is limited by fin/stop locks 30. In self-propelled flare embodiments, nozzles or other openings (not shown) may be provided at the base end of case 20, which is denoted by dotted lines in FIG. 4. These nozzles provide an opening for escaping combustion gases which serve both to propel the flare forward and to provide the necessary IR signature.

When used as part of a propelled flare embodiment, such housings may be launched into the air using a charge of propellant (such as smokeless powder or a suitable modification of the IR pyrotechnic composition formula as mentioned below) in a manner known in the art. Advantageously, such propelled flare configurations provide a propelled decoy flare which remains closer to a flying aircraft for a longer period of time than a standard nonpropelled decoy flare. In a preferred embodiment the propelled flare decoy may exceed the velocity of the aircraft though diverging from its course. This provides more effective anti-missile protection and may reduce the number of deployed flares that are required to protect an aircraft during a given engagement.

Figure 5:
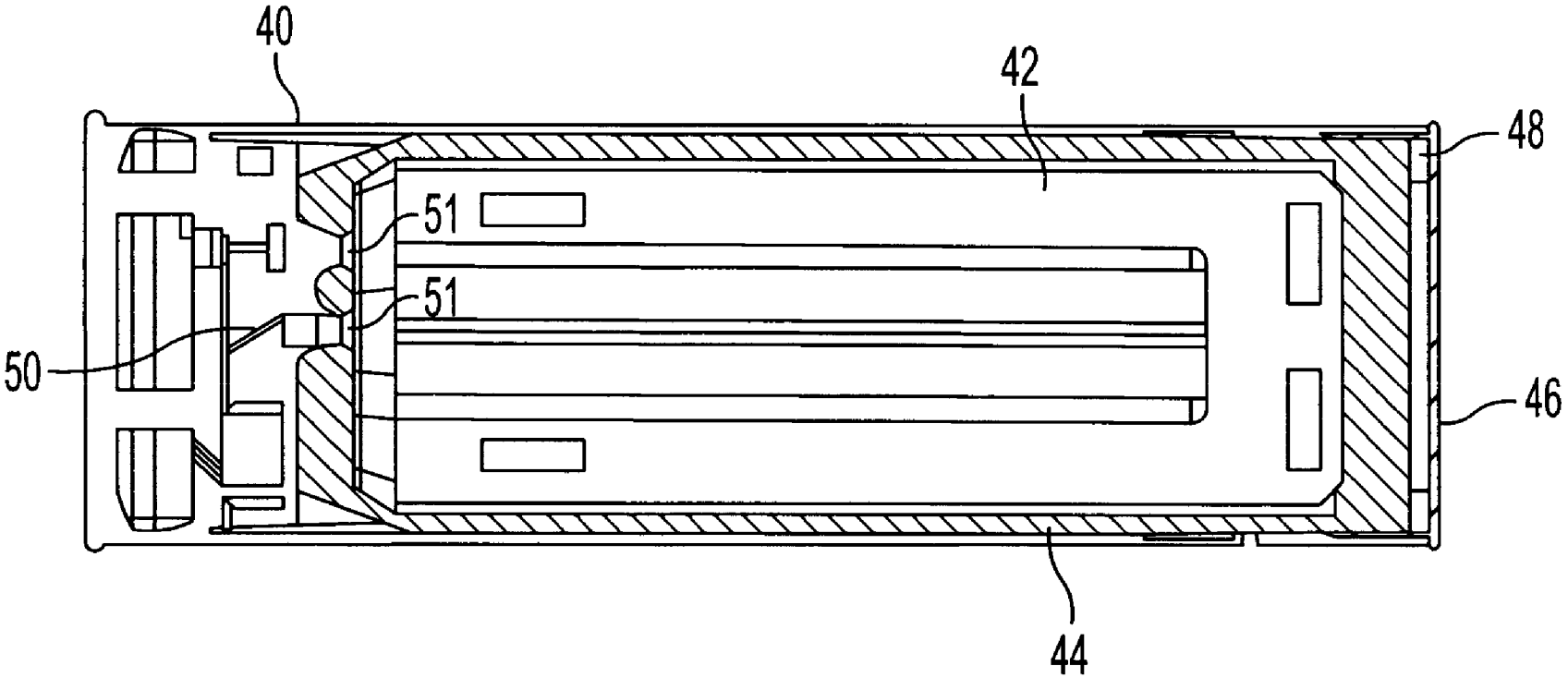
FIG. 5 is an illustration of a flare decoy having a pyrotechnic pellet configured to function as a propellant according to one embodiment of the disclosed method and apparatus.

In another flare decoy embodiment illustrated in FIG. 5, a flare case 40, typically aluminum, for containing a propellant charge or grain 42 (comprising a pyrotechnic composition according to the present disclosure) within a phenolic housing 44 is provided. Such a flare case typically includes a metallic (e.g., copper, etc.) nose 48, end cap 46, and safe and initiation device 50. Nozzles 51 are typically positioned as shown. In operation, grain 42 and housing 44 is typically expelled out of flare case 40 by an explusion cartridge (not shown), thereby displacing end cap 46. Once expelled from the case, the "safe and initiation" device 50 ignites propellant charge 42 which acts as a rocket motor to propel the housing 44 forward via burning gases escaping through nozzles 51;

When used as a propellant, the disclosed pyrotechnic composition may also be used to propel any other types of flares, rockets, or other projectile device known in the art. When used as a decoy flare propellant, the disclosed pyrotechnic composition is typically a single pellet placed within the flare housing, although other embodiments having multiple pellets, grains, powders, etc. may also be employed.

In addition to use as a propellant for a decoy flare or other projectile, the disclosed flare and propellant composition may also be used as a gas-generating propellant for other devices such as airbags. In one embodiment, the disclosed pyrotechnic composition may be utilized in an airbag deployment system for automobile airbags, such as side mounted airbags. Advantageously, the low toxicity and hydrogen content of the disclosed flare and propellant compositions provide an airbag deployment system propellant which reduces danger of harm to occupants of an automobile when airbags are employed. Specifically, the low hydrogen content of the disclosed flare and propellant compositions reduces the amount of water generated during combustion, and thereby reduces the specific heat of the combustion products by minimizing the amount of water vapor in the combustion gas. This reduces the chance of scalding or burning of the occupants upon deployment of the airbag. In a typical airbag installation, disclosed flare and propellant compositions are employed in the form of small granules or pressed perforated discs. Advantageously, these propellants have very good thermal stability, react promptly and produce gas with a minimal water vapor content.

Pyrotechnic compositions and additives may be employed as air bag inflation charges in compositional embodiments as previously described. However, formulations of the disclosed pyrotechnic compositions intended for use in vehicle air bag inflation embodiments may be modified to reduce the operating flame temperature and to change the burning rate/pressure characteristics as desired. For example, "hotter" fuels (i.e., those with flame temperatures greater than about 2200° K), may be wholly or partially replaced by those yielding a substantially nontoxic gas high in carbon dioxide but lower in temperature (i.e., less than about 1800° K) than the formulations intended for the production of decoy-type infrared light. Typical examples of fuels meeting these criteria include, but are not limited to, mixed lactone polymers of hydroxyacetic acid, lactic acid, and/or tartaric acid; stable combined forms of maleic anhydride or phthalic anhydride alone or in chemical or physical admixture with other disclosed fuels; and/or dicyandiamide. Lactone polymer fuels are typically favored as being of low toxicity and sufficiently high molecular weight (i.e., about 600 grams per mole) to act as both binder and fuel. In a typical air bag inflation embodiment, there may also be added burning rate catalysts in order to gain the necessary high burning rates at technologically favorable low operating pressures (i.e., less than about 500 psi). Examples of such catalysts include, but are not limited to, potassium benzoate, potassium bitartrate, the potassium salts of BTCA or benzophenone tetracarboxylic dianhydride ("BPDA") parent acids, mellitic acid, phthalic or nitro phthalic acid, or mixtures thereof. Other suitable burning rate catalysts include, but are not limited to, p-benzoquinone dioxime or monoxime, iron oxide, manganese dioxide, amorphous carbon, copper oxide, copper acetylacetonate, and mixtures thereof. To further increase gas volume, decrease flame temperature and provide an alkaline residue to absorb hydrogen chloride formed during the main reaction, potassium nitrate may be substituted for some proportion of potassium perchlorate oxidizer.

Afterburning Embodiments

Figure 6:
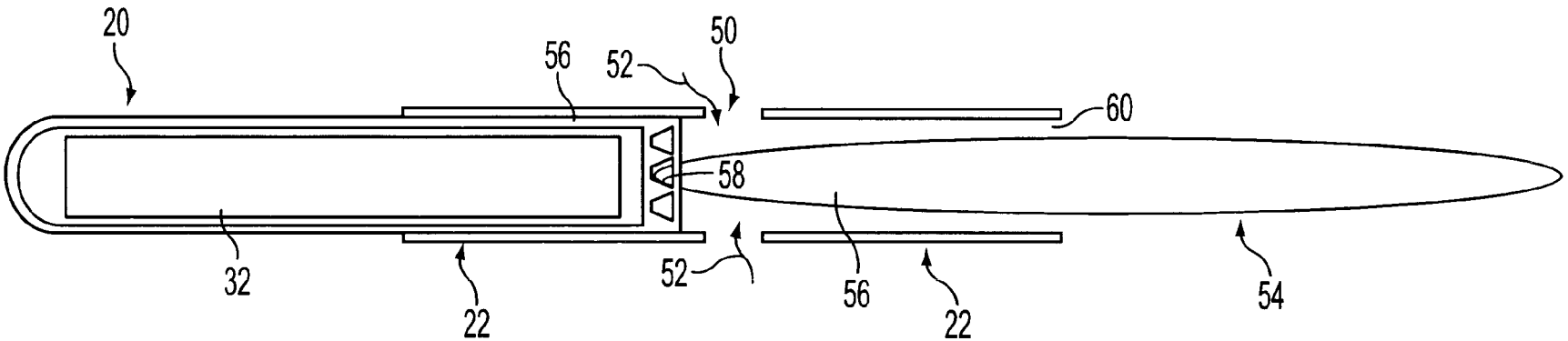
FIG. 6 is an illustration of a flare decoy having a pyrotechnic pellet and configured to afterburn combustion gas according to one embodiment of the disclosed method and apparatus.

The disclosed pyrotechnic composition may be employed in embodiments in which only partial combustion of the composition occurs inside a housing, with remaining combustion occurring in the atmosphere outside the housing. FIG. 6 illustrates a decoy flare similar in design to that illustrated in FIG. 4, but configured in one such possible afterburing embodiment. Advantageously, such embodiments reduce the amount of oxidizing agents required, thereby allowing greater amounts of active fuel component to be employed for a given housing size. In such embodiments, stoichiometry of the pyrotechnic fuel/oxidizing agent mixture is adjusted so that the mixture produces partially oxidized components, such as carbon monoxide, inside the flare housing. Gases containing these partially combusted materials may then be expelled from the housing in such a way that they are mixed with atmospheric oxygen and controllably combusted further to gases such as carbon dioxide and nitrogen. Advantageously, such afterburning configurations allow increased amounts of active fuel components to be employed, and thus more carbon dioxide IR-radiating species to be produced. In one embodiment, a housing device may be configured so that propulsion is provided by the afterburning gases in a manner similar to a ram jet. Such embodiments of the disclosed method and apparatus offer a longer burn time and greater carbon dioxide production (and therefore long wavelength IR radiation) for a given housing volume.

Afterburning embodiments of the disclosed method and apparatus may employ pyrotechnic compositions which are configured in a variety of grain shapes such as those described previously, including, for example, single pellets, multiple pellets, powder spheres, etc. In addition, afterburning pyrotechnic compositions may be employed in any housing or similar device suitable for producing and expelling partially combusted gas for further combustion. This include housings or devices having any type of suitable openings including, but not limited to, one or more nozzles, holes, apertures, or other openings. A typical afterburning pyrotechnic composition may employ any mixture of combustible fuels and other additives known in the art. Typically, such an embodiment employs the active fuel components, oxidizing agents, binders, accessory materials, and ignition layers described in this disclosure for other embodiments. However, mixture components are typically combined in such a way that insufficient oxidizing agent for complete combustion of the active fuel component is employed.

In a typical afterburning pyrotechnic composition, from about 40% to about 95%, more typically from about 50% and about 85%, and most typically between about 65% and about 80% of the stoichiometric amount of oxidizing agent required for complete combustion of an active fuel component is typically employed. For example, a typical afterburning pyrotechnic composition employs from about 28% to about 40% polycarboxylic polyanhydride, from about 69% to about 45% oxidizing agent (such as potassium perchlorate) and from about 3% to about 14% binder and other additives. More typically, an afterburning pyrotechnic composition employs from about 30% to about 35% polycarboxylic polyanhydride, from about 62% to about 53% oxidizing agent, and from about 8% to about 12% binder and other additives. It will be understood with benefit of this disclosure that afterburning pyrotechnic compositions may be formed using any suitable combination of active fuel component, oxidizing agent, and other optional additives (including, but not limited to, those pyrotechnic composition additives. disclosed herein).

In the afterburning flare embodiment illustrated in FIG. 6, shroud 22 is configured to slide back on case 20 as described for the flare embodiment of FIG. 4. However, in the embodiment of FIG. 5, air inlets 50 are provided in shroud 22, typically near flare openings or nozzles 58 as shown, so that entrained air 52 may enter a combustion area 56 formed within shroud 22. Partially combusted gases formed by burning grain 32 are therefore furnished with additional air for combustion through inlets 50, thus generating further combustion within shroud 22 and typically forming an afterburning combustion plume 54 extending beyond the open end 60 of shroud 22. In this and similar embodiments, the afterburning gases generate propulsion for the flare within the afterburning combustion chamber or area 56. Although one embodiment of an afterburning flare configuration is depicted in FIG. 6, it will be understood with benefit of the present disclosure that any other flare embodiment providing a suitable afterburning area for burning partially oxidized gases from a pyrotechnic flare composition may be employed. Furthermore, it will be understood that any of the pyrotechnic flare compositions (including fuel and other additives) disclosed herein may be employed as fuel or a grain for an afterburning embodiment, as may any other flare compositions known in the art.

In addition to those ranges and compositions described above, it will be understood with benefit of the present disclosure that the stoichiometry of active fuel component and oxidizing agent may be adjusted such that a continuum of potential mixture embodiments is provided, from those mixtures yielding complete combustion of carbon to carbon dioxide to those yielding only partial combustion to carbon monoxide within a housing or other device.

EXAMPLES

The following examples are illustrative and should not be construed as limiting the scope of the invention or claims thereof.

Intensity Testing

Example 1

Infrared Burn Characteristics

A series of intensity tests were conducted on coupons made of a pyrotechnic composition of the disclosed method and apparatus to gain radiometric data on the composition under windstream conditions. Test coupons having a weight from 2.5 g to 95 g were pressed and burned. These coupons were formed of the disclosed pyrotechnic compositions having various proportions of BTCA, perchlorate, burn rate modifiers and binders, as well as of standard flare compositions as indicated below for comparison purposes.

During the intensity testing, the composition or device to be tested was held centered one foot from the end of a ten-inch diameter blowdown tube. A Pitot tube near the specimen was used to measure the air velocity. Dry air held in a pressure tank at 200–300 psig was released through a control valve controlled manually or by the Pitot output. The IR output was measured with a Laser Precision KT-3000 radiometer, KTS 215 power supply, and CTX 534 chopper module plus appropriate bandpass filters. The signals were amplified with EG&G 5101 amplifiers and recorded by an IBM clone computer. The radiometers were calibrated with an IR Industries #463 blackbody and #101Cd temperature controller.

Figure 7:
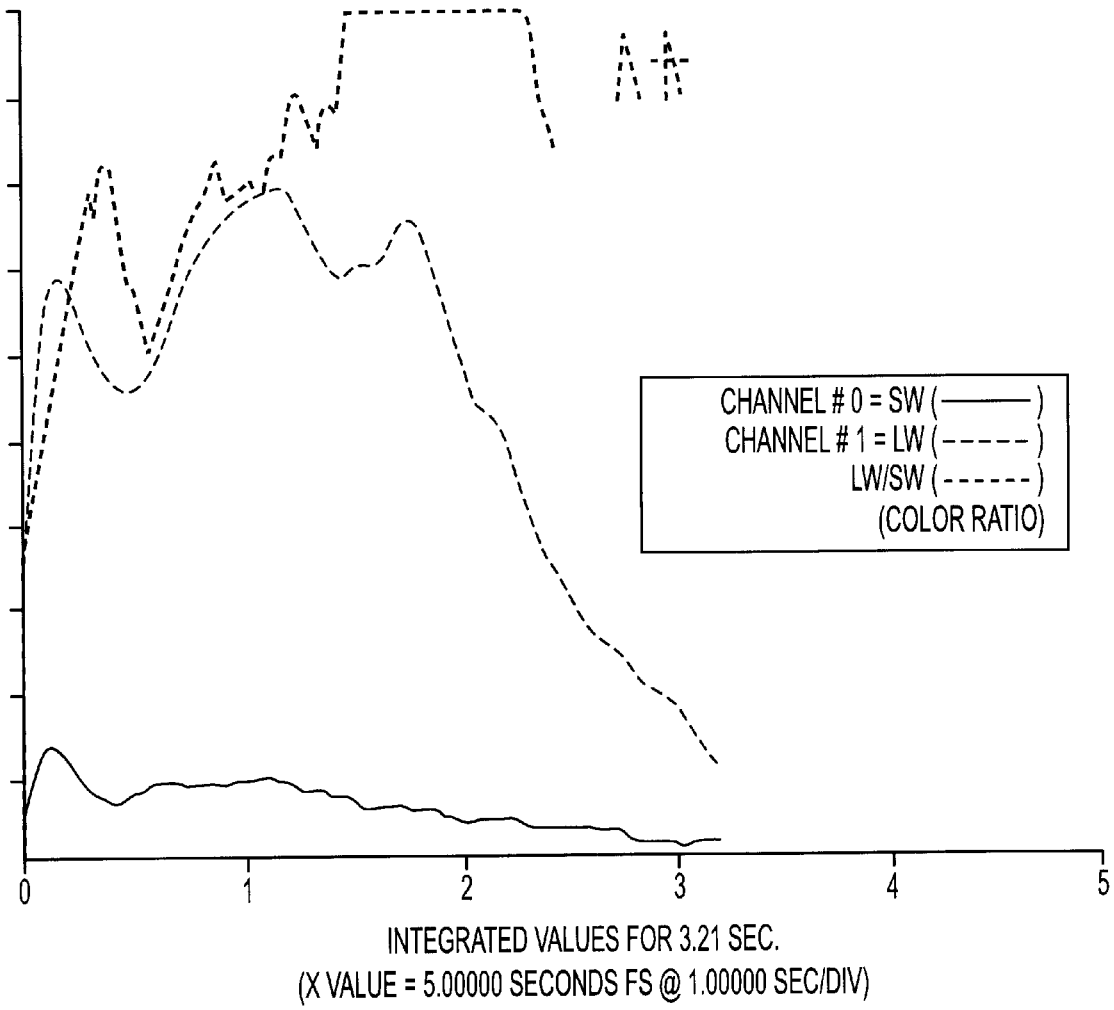
FIG. 7 shows infrared burn characteristics for a pyrotechnic composition according to one embodiment of the disclosed method and apparatus.
Figure 8:
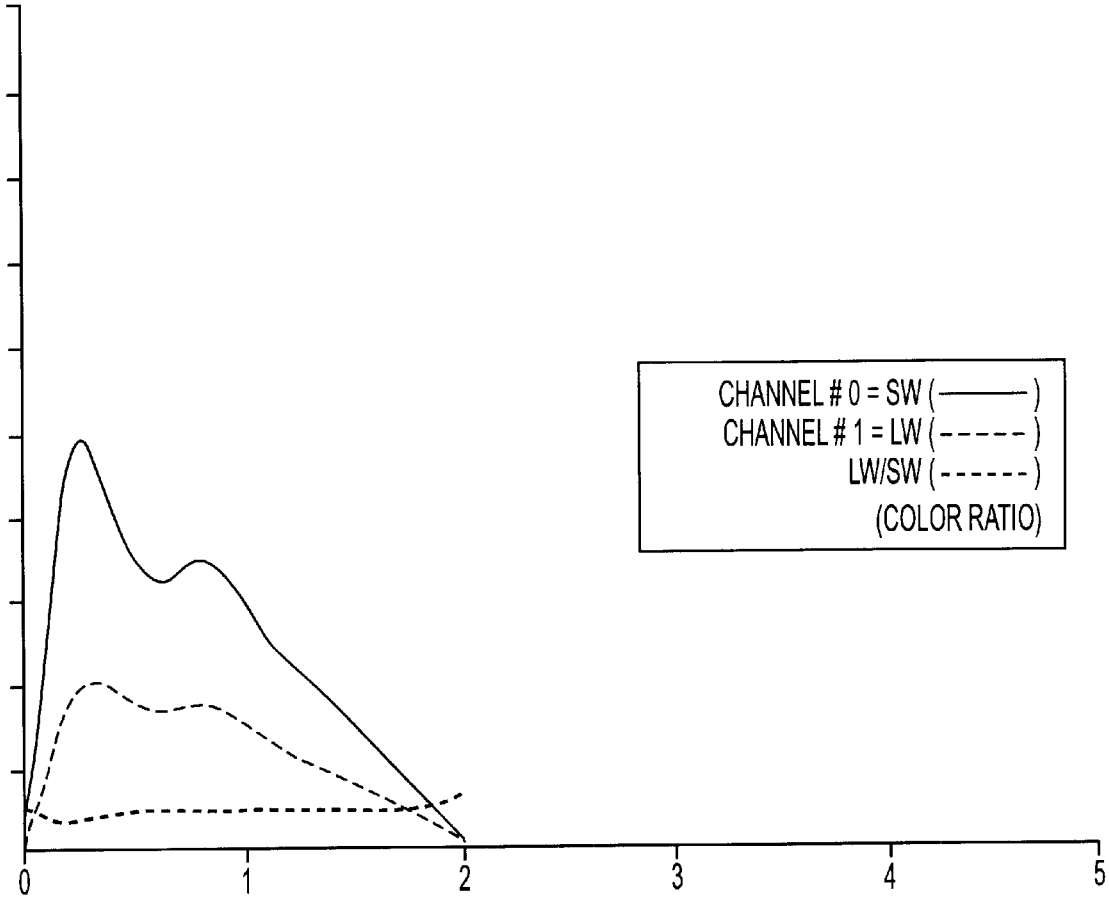
FIG. 8 shows infrared burn characteristics of a standard magnesium-Teflon-"VITON" mixture ("MTV").
Figure 9:
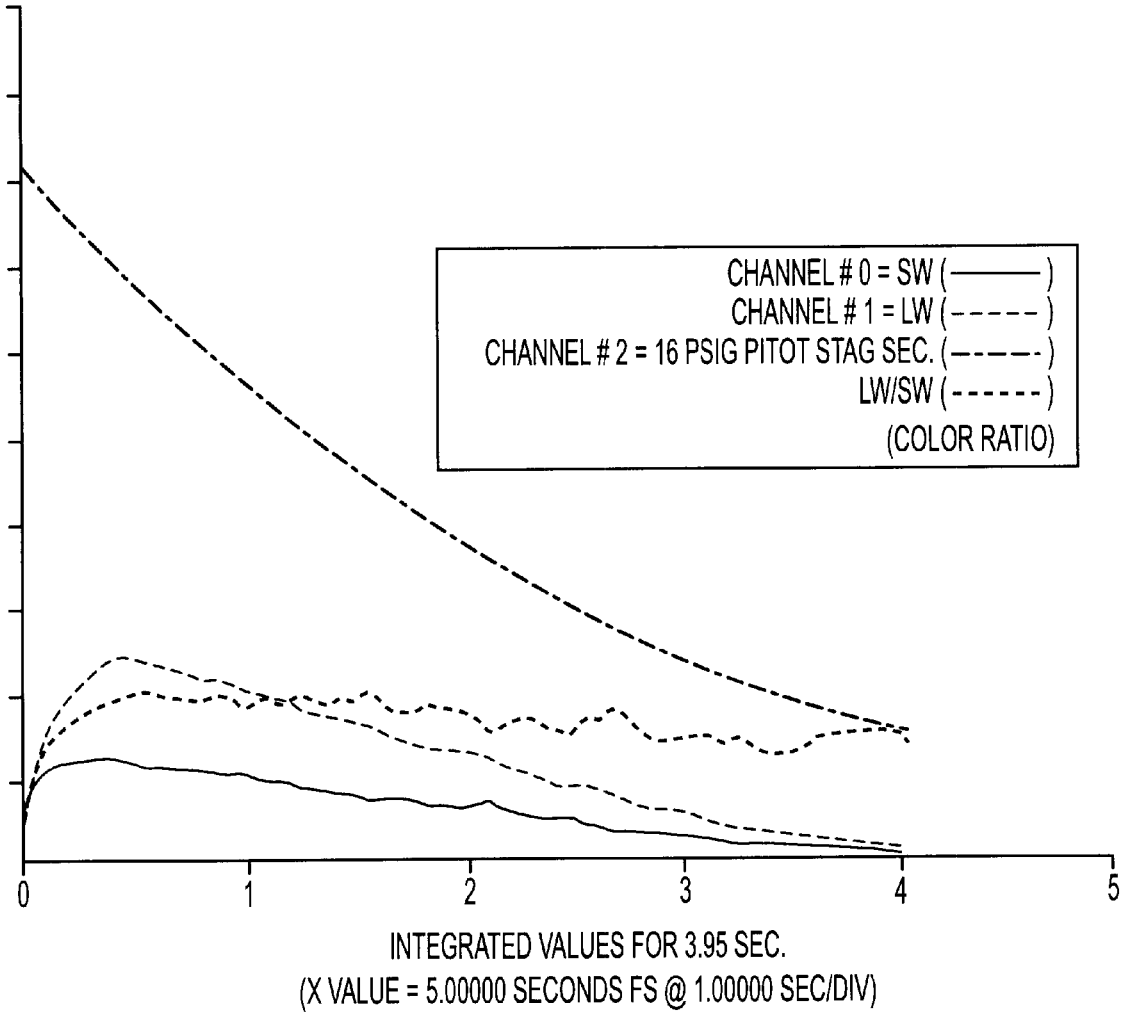
FIG. 9 shows infrared burn characteristics of the same pyrotechnic composition of FIG. 7 when burned in a windstream according to one embodiment of the disclosed method and apparatus.

FIGS. 7–9 represent the results of the intensity testing. With respect to FIGS. 7–9, values of LW output intensity (dashed line), SW output intensity (solid line), windstream Pitot tube windstream velocity (dashed/dotted line), and LW/SW color ratio (heavy dotted line) are plotted versus time in seconds. In each figure, Channel #1 reads LW and Channel #0 reads SW. The intensity units of output measure are watts per steradian (w/sr), and the units of windstream velocity are in Mach number. With regards to the graduated Y-axis values, the output intensity scale ranges have been adjusted for best data display. The range of Y-axis values for Mach number is 0 to 1.0, and for LW/SW color ratio is 0 to 10.0.

FIG. 7 relates to one embodiment of the disclosed pyrotechnic composition composed of a pressed grain comprising 26.6% micronized BTCA, 68.4% powdered potassium perchlorate, and 4.0% "KRATON 1101" thermoplastic rubber binder. FIG. 7 shows infrared burn characteristics of this mixture burned under still air conditions. Under these conditions, the color ratio is from 6.2 to greater than 10, depending on the stage of the pellet burn considered. Such a color ratio is more than satisfactory for decoying typical color-discriminating missiles.

FIG. 8 shows infrared burn characteristics of a standard magnesium-Teflon-"VITON" mixture ("MTV") having 60 weight % Mg/ 30 weight % Teflon/ 10 weight % "VITON" when burned in still air. Note that the short-wave IR output exceeds the long-wave IR output considerably. In this case, the color ratio is about 0.5. This color ratio is characteristic of compositions whose radiation is primarily from hot solid particles. Such an IR output would typically not be effective in decoying a color-discriminating missile.

FIG. 9 shows results for the disclosed pyrotechnic composition of FIG. 7 burned in a windstream whose velocity falls essentially continuously from Mach 0.85 during the test. In this case, such as would actually occur if decoy employing it were ejected from an aircraft, the color ratio under these severe conditions is about 2.0. This color ratio would be effective to decoy typical color-discriminating missiles.

Figure 10:
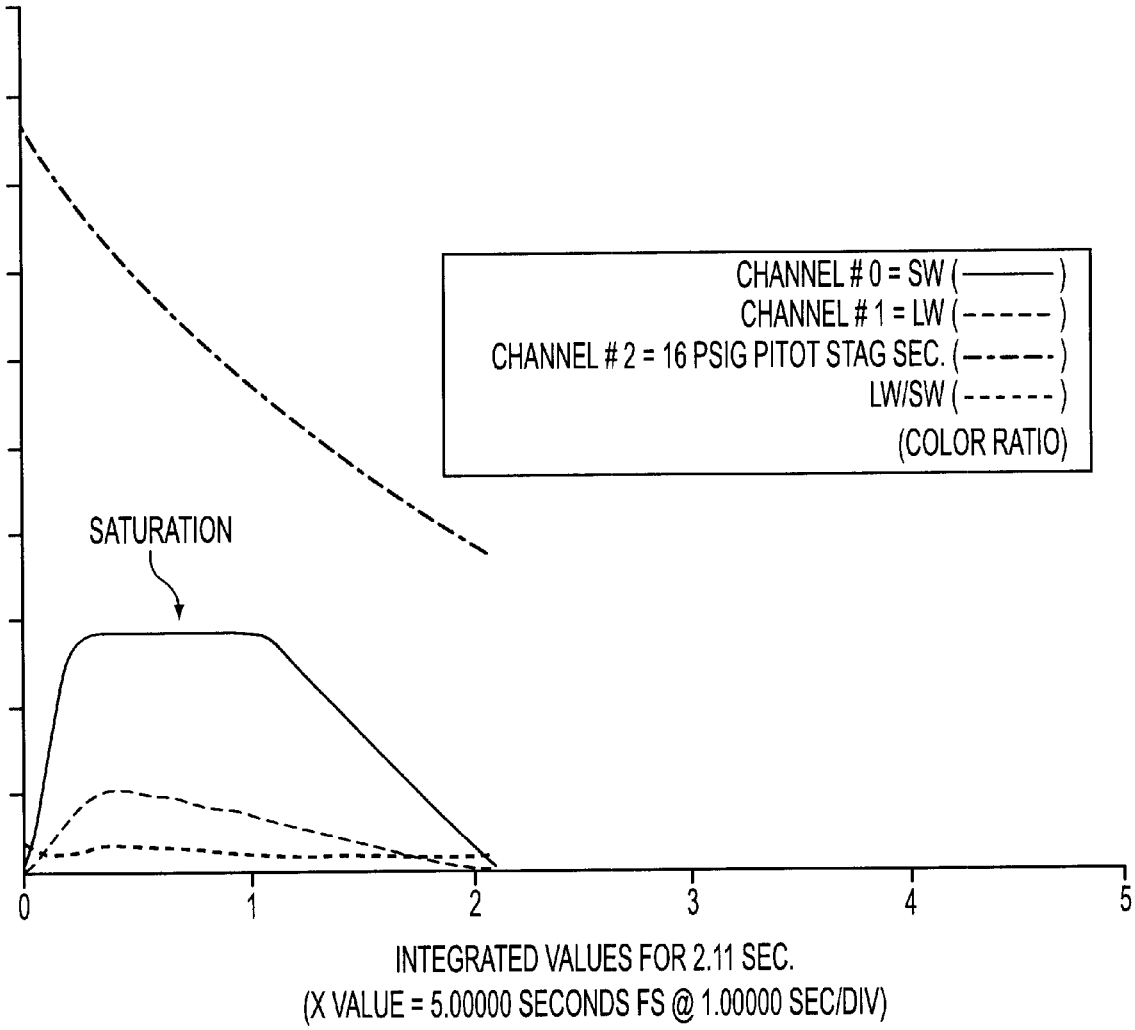
FIG. 10 shows infrared burn characteristics of the same standard flare composition of FIG. 8 when burned in a windstream.

FIG. 10 shows results for the same MTV composition of FIG. 8 burned under windstream conditions. In this case, the air flow starts at about Mach 0.85 and falls during the duration of the test. The color ratio is even poorer than that exhibited in FIG. 8, falling to about 0.35, and would not be an effective decoy for a typical color-discriminating missile.

The results of this example demonstrate that embodiments of the disclosed pyrotechnic composition burn under conditions of high wind or airflow with a substantially reduced degradation of the ratio between long and short IR wavelengths over previous flare compositions.

The disclosed pyrotechnic compositions offer advantages over a wide variety of standard flare compositions, in addition to those tested above. For example, even though boron-fueled compositions typically exhibit somewhat better color ratio in static test burns than the standard flare composition tested above, the color ratio of such boron composition typically inverts to a poorer ratio under windstream conditions. Red phosphorus compositions (not illustrated) typically exhibit similar failures to provide the necessary IR color ratio under windstream conditions simulating actual aircraft use. Therefore, previous standard flare compositions generally fail to provide the IR wavelength ratios necessary to protect aircraft from modern antiaircraft missile threats.

Pyrotechnic Compositions

Example 2

Potassium perchlorate oxidizer was air-milled with the addition of 0.25% silica aerogel flow aid to 3–5 microns particle size as measured by the Fisher Sub-Sieve Sizer. The polycarboxylic acid derivative chosen was BTCA, previously fluid energy milled to 5 microns particle size as measured similarly. A 10% (weight/weight) cyclohexane solution of Kraton 1101 binder containing 0.25% (rubber basis) Irganox 1010 antioxidant was placed in the mixing bowl of a Hobart air-driven mixer. The weight of solution was sufficient to contain 4.0% binder for the (600 gram) batch. 200 $cm^3$ cyclohexane was added, then 26.6% micronized BTCA and 0.25% Cabot Monarch 280 conductive carbon. The slurry was blended at about 1 rps for 5 minutes, then the potassium perchlorate (68.4%) was added and mixing resumed for 30 minutes. During this time the solvent largely evaporated. The slightly damp composition was rubbed through a 16-mesh screen then dried for 8 hours in a forced-convection explosion-proof oven at 180° F. The composition was preheated to 80° C., and pressed remotely at a total force of about 250 tons to form a pellet of dimensions 0.86×1.93×6.1 inches. The material exhibited a color ratio of greater than 1.5 to 1 under Mach 0.85 windstream conditions. In the pressed, dense condition, a 1.93 inch diameter cylinder of the material was non-detonable at zero attenuator cards in the standard US Military Card Gap Test.

Example 3

Potassium perchlorate (20 micron powder) 63.4%, and 0.25% Monarch 280 carbon were mixed with 4.0% Viton A fluoroelastomer (as a 10 weight % solution in amyl acetate) and 200 $cm^3$ of amyl acetate on a magnetic stirrer for 10 minutes. BTCA (5 micron) 32.4% was added and mixed for another 15 minutes. Then 2500 $cm^3$ hexane (commercial) was added while the mixing continued. The mixer was turned off, the solids allowed to settle, and the supernatent liquid decanted. Another 2000 $cm^3$ hexane were added, magnetic stirring continued for 5 minutes, then stopped and the supernatent removed as above. The granular "shock gelled" composition was drained, put through a 16-mesh screen, and dried as above. It was then pressed into 0.25 inch thick discs at ambient temperature, coated with an ignition layer and dried. The discs were ignited and ejected from a short tube by their own developed gas pressure. They formed a disperse useful IR decoy material with a color ratio of 1.4 in flight and a lower burning rate than that in Example 2.

Example 4

BTCA powder (5 micron) 22.6%, Monarch 280 carbon 0.21%, and 3.15% Kraton 1107 thermoplastic rubber binder (plus 0.5% Irganox 1010 antioxidant), as a 10% (wt.) solution in cyclohexane, were mixed with an. extra 200 $cm^3$ cyclohexane in an air-powered Hobart mixer for 5 minutes . The mixer was stopped and 0.21% Ganex V220 dispersant and 74.0% 5-micron potassium perchlorate were added. The mixture was blended for 30 minutes at about 1 rps Hobart agitator speed. Then a controlled flow of warm dry air was started for solvent evaporation. Agitation and evaporation were continued until a slightly-damp coarse powder was formed. The product was passed through a 16-mesh screen and dried as above. The dried product was pressed at ambient temperature and 30 tons force to produce a cylindrical test grain of 1.36 inch diameter. The composition thus formed had a better surface finish than that in Example 2. The color ratio produced was about 6/1 at Mach 0.46.

Example 5

A mixture of 77% potassium perchlorate and 18% NTAN (nitrilotriacetonitrile) was ball-milled 24 hours with isopropyl alcohol vehicles and ceramic balls. The vehicle was separated from the composition components, which were then suspended in enough 10% acetone-Viton A solution to provide 5% binder in the finished composition. The mixture was shock-gelled as described above. The compound was pressed to a density of 1.91 grams per $cm^3$, providing an IR color ratio of 1.9/1 in still air.

Example 6

Potassium perchlorate 64.1% and "TLF" poly (hydroxyacetic acid) powder 32.2% were blended with 4% Viton A (as 10% solution in acetone) with the aid of a magnetic stirrer. Hexane was added to shock gel the composition as illustrated above. The product produced a color ratio of 2.1 when burned under ambient conditions.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed compositions, methods and devices may be utilized in various combinations and/or independently. Thus the invention is not limited to only those combinations shown herein, but rather may include other combinations.

What is claimed is:

1. A decoy flare comprising:

a first flare housing having an interior and exterior;

a pyrotechnic composition adapted to be received and combusted in said interior of said first flare housing, said pyrotechnic composition comprising:

from about 8% to about 60% by weight of an aromatic polycarboxylic anhydride fuel component;

from about 40% to about 90% by weight of an oxidizing agent;

from about 1% to about 20% by weight of a binding agent; and an ignition layer surrounding at least a portion of said pyrotechnic composition.

2. The flare of claim 1 wherein said flare further comprises a second flare housing having an interior and an exterior, said first housing being coupled to said second housing; and wherein said pyrotechnic composition has an afterburning stoichiometry and comprises an amount of oxidizing agent sufficient to supply between about 40% and about 95% of the stoichiometric amount of oxidizing agent required for complete combustion of said fuel component;

wherein said pyrotechnic composition comprises from about 28% to about 40% by weight of said fuel component and from about 45% to about 69% by weight of said oxidizing agent;

wherein said pyrotechnic composition is adapted to be received and combusted in said interior of said first flare housing;

wherein said first flare housing has one or more outlet openings extending from the interior of said first flare housing to said interior of said second flare housing, said openings configured to allow partially oxidized combustion materials generated by oxidation of said fuel component within said first flare housing to escape from said first flare housing interior into said second flare housing interior;

wherein said partially oxidized materials are oxidized further within said second flare housing interior so that additional combustion materials are generated within said second flare housing; and wherein said second flare housing has one or more outlet openings extending from the interior to the exterior of said second flare housing to allow said original combustion materials and said additional combustion materials to escape from the interior of said second flare housing so that a propellant force is generated to propel said flare.

3. The flare of claim 2, wherein said second flare housing has one or more inlet openings adapted to allow oxygen containing gas into said interior of said second flare housing.

4. The flare of claim 1, wherein said first flare housing has one or more openings extending from an interior of said flare housing to an exterior of said first flare housing, said openings configured to allow combustion materials generated by oxidation of said fuel component within said first flare housing to escape from said first flare housing interior so that a propellant force is generated to propel said flare.

5. The flare of claim 1, wherein combustion of the pyrotechnic composition produces an output infrared color ratio of greater than about 1.0.

6. The flare of claim 1, wherein the aromatic polycarboxylic anhydride comprises benzene tetracarboxylic acid dianhydride.

7. The flare of claim 5, wherein during combustion the pyrotechnic composition produces an output infrared color ratio of greater than about 1.0 under windstream conditions of up to at least about Mach 0.75.

8. The flare of claim 1, wherein the fuel component comprises at least one of benzene tetracarboxylic dianhydride, benzophenone tetracarboxylic dianhydride, benzene hexacarboxylic acid trianhydride, or mellitic anhydride.

9. The flare of claim 1, wherein the binding agent comprises at least one curable reactive resin.

10. The flare of claim 9, wherein the binding agent comprises epoxy resin.

11. The flare of claim 1, wherein during combustion the pyrotechnic composition produces a combustion product having a molecular ratio of $CO_2$ to $H_2O$ of greater than about 1.0.

12. The flare of claim 1, wherein the fuel component comprises from between about 20% and about 35% by weight benzene tetracarboxylic acid dianhydride or mellitic dianhydride, the binding agent comprises from about 2% to about 8% by weight synthetic rubber, and the oxidizing layer comprises from about 60% to about 80% by weight potassium perchlorate.

13. The flare of claim 1, wherein the pyrotechnic composition has an afterburning stoichiometry, said pyrotechnic composition comprising an amount of oxidizing agent sufficient to supply between about 40% and about 95% of the stoichiometric amount of oxidizing agent required for complete combustion of the fuel component.

14. The flare of claim 1, wherein the pyrotechnic composition has an afterburning stoichiometry, the pyrotechnic composition comprising between about 28% and about 40% by weight of the fuel component, and between about 45% and about 69% by weight of the oxidizing agent.

15. A decoy flare comprising:

a pellet including at least one aromatic polycarboxylic acid anhydride;

an inhibitor layer surrounding at least a portion of the pellet; and a case containing the pellet.

16. The flare of claim 15, further comprising a shroud slidably mounted around the case.

17. The flare of claim 16, further comprising one or more fins coupled to the shroud.

18. A decoy flare comprising an afterburning pyrotechnic composition, the composition comprising:

from about 28% to about 40% by weight of a polycarboxylic anhydride fuel component;

from about 45% to about 69% by weight of an oxidizing agent; and from about 3% to about 14% by weight of a binding agent.

* * * * *

UNITED STATES PATENT AND TRADEMARK OFFICE

CERTIFICATE OF CORRECTION

PATENT NO. : 6,427,599 B1 
DATED : August 6, 2002
INVENTOR(S) : Posson et al.

It is certified that error appears in the above-identified patent and that said Letters Patent is hereby corrected as shown below:

Title page,
Item [54], please delete "THEREFORE" and insert -- THEREFOR -- therefor.

Signed and Sealed this

Twenty-first Day of January, 2003

JAMES E. ROGAN
*Director of the United States Patent and Trademark Office*